US008132932B2

(12) United States Patent
Xhunga

(10) Patent No.: US 8,132,932 B2
(45) Date of Patent: Mar. 13, 2012

(54) RECESSIBLE TASK LIGHTING

(76) Inventor: Ilo Kristo Xhunga, Avon, OH (US)

( * ) Notice: Subject to any disclaimer, the term of this patent is extended or adjusted under 35 U.S.C. 154(b) by 0 days.

(21) Appl. No.: 12/915,670

(22) Filed: Oct. 29, 2010

(65) Prior Publication Data

US 2011/0103075 A1 May 5, 2011

Related U.S. Application Data

(60) Provisional application No. 61/256,975, filed on Oct. 31, 2009.

(51) Int. Cl.
*F21V 33/00* (2006.01)

(52) U.S. Cl. ..... 362/127; 362/198; 362/147; 362/431; 362/387

(58) Field of Classification Search ..... 362/127, 362/147, 431, 198, 387, 407, 418
See application file for complete search history.

(56) References Cited

U.S. PATENT DOCUMENTS 2,667,323 A * 1/1954 Mason ..... 248/298.1
5,280,416 A * 1/1994 Hartley et al. ..... 362/98
7,311,410 B2 12/2007 Marka
7,341,363 B1 3/2008 Richardson
7,390,105 B2 6/2008 Nelson et al.
7,494,254 B2 2/2009 Rogers
7,500,759 B2 3/2009 Lin
7,690,822 B2 4/2010 Kauffman
7,810,945 B2 10/2010 Mize
7,845,830 B2 12/2010 Chan
2006/0114681 A1 6/2006 Wang
2009/0122563 A1 5/2009 Ko et al.
2009/0244913 A1 10/2009 Anglikowski et al.
2010/0097816 A1 4/2010 Chen et al.
2010/0246196 A1 9/2010 Jurik
2010/0277108 A1 11/2010 McDonnell
2010/0296301 A1 11/2010 Xhunga
2011/0038064 A1 2/2011 Xhunga

* cited by examiner

*Primary Examiner* — Laura Tso

(57) ABSTRACT

A recessible task lighting device comprises lighting source (207), retracting box (203), and vertically polarized gooseneck (209) connected between (207) and (203). Lighting source (207) is disposed inside a recessed location when not in use. The recessed location can be the tableside under a work table, an adjacent wall, or a pole stand or floor stand. Lighting source (207) can be pulled out from the recessed location to a task lighting position over a tabletop or over the lap area of the user and directed selectively to the viewing spot. Due to the special mechanical properties of the vertically polarized gooseneck, the lighting source can be supported up to about three or four feet horizontally from the recessed location. With pushbutton (55) pressed, lighting source (207) will move out of the way towards retracting box (203).

11 Claims, 19 Drawing Sheets

RECESSIBLE TASK LIGHTING

PRIORITY

This application claims priority of my provisional patent application U.S. 61/256,975 entitled Recessible Task Lighting Device filed on Oct. 31, 2009.

TECHNICAL FIELD

This invention relates to task lighting, more specifically to task lighting directed towards a tabletop area.

BACKGROUND ART

There is a variety of conventional lighting fixtures. They are used for general, ambient, or flood lighting, and for specific, task, or spot lighting. They suspend from ceilings, affix on wall sconces, stand on tables, or attach on floor stands.

In spite of the variety, the prior art is missing a task or spot lighting device that after use could recess inside an adjacent wall or in the side of the table with the press of a button.

DISCLOSURE OF INVENTION

Three embodiments of a task lighting device are described in detail. Described embodiments are recessible into the side of a working table, inside a room wall adjacent to the table, or into a dedicated floor stand. The device comprises a lighting source that is equipped with an electric switch and with gripping means for pulling out and repositioning the lighting source, a retracting enclosure having a retracting means and a lock-and-release mechanism, and a cross-sectionally polarized gooseneck connecting the lighting source with the retracting enclosure. The polarized gooseneck carries conducting wires along its length. The retracting enclosure is disposed inside a tableside, inside an adjacent wall, or on a floor stand, or pole stand. The lighting source is disposed in a stowed location on the front side of the retracting enclosure. The user can pull out the lighting source from the recessed location to a task lighting location. The polarized gooseneck holds the lighting source fixed in place in the pulled-out location for the best lighting of the viewing spot. At the end, the user can activate the lock-and-release mechanism and the polarized gooseneck will be retracted into the retracting enclosure while automatically pulling the lighting source out of the user's way towards the recessed location.

BRIEF DESCRIPTION OF DRAWINGS

The accompanying drawings in conjunction with the detailed description illustrate embodiments of the invention and explain its principles.

THE BEST MODES FOR CARRYING OUT THE INVENTION

First Embodiment—FIGS. 1A to 19

While the second and third embodiments represent the invention in its entirety, the first embodiment is a special case that represents a more restricted aspect of the invention than the general case. The general case demonstrated by the second and third embodiments uses cross-sectionally polarized goosenecks with rigidities that vary remarkably with polarities.

On the other hand, the first embodiment employs a specific gooseneck of zero polarity; the gooseneck is circularly symmetric. The first embodiment is a special case of a more general one like the circle is a special case of the ellipsis. While eccentricities of ellipses can vary in the range from zero to one, the circle is a special case of an ellipsis with eccentricity zero. Actually this analogy is very close to the actual gooseneck cross-sections which are vertically elongated, ellipsis being the first approximation of their actual forms.

The above circular cross-section reduces the horizontal displacement of the lighting source when it is retracted out from the exit point at the recessed location. The circular gooseneck can tolerate only small lateral displacements without sagging. The first embodiment can be used only in those applications where horizontal displacements from the recessed locations are not required to be very large (normally less than one foot). By employing the circular gooseneck, recessible lighting device is simpler and less expensive. The first embodiment can be mounted, as an example, on the side of the table in front of which the user is sitting. From that location the unit can be deployed to a suitable lighting position by being retracted typically upwards rather than sideways. The lighting device can be mounted on the sideboard under the edge of the tabletop. It can be installed on the front side of the table, as above mentioned, or alternatively, it can be mounted on the left or on the right side, provided it is within the hand reach of a sitting person.

Figure 1A:
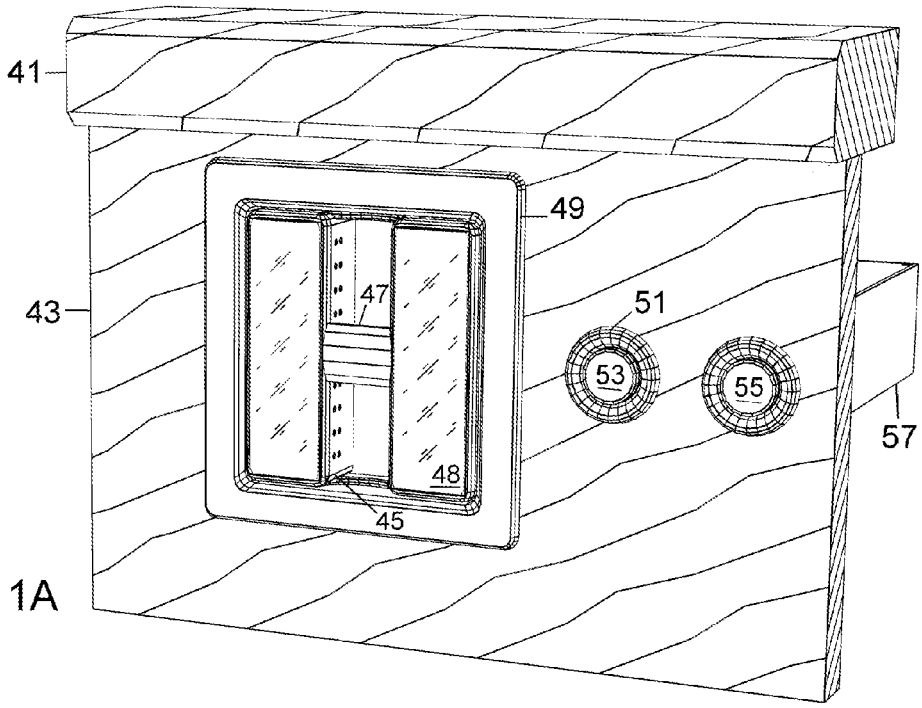
FIG. 1A and FIG. 1B are front and back views of the recessible lighting device mounted on the side of a table. Cutaway parts of the side of the tabletop and the sideboard of the table are shown with cross sections.
Figure 1B:
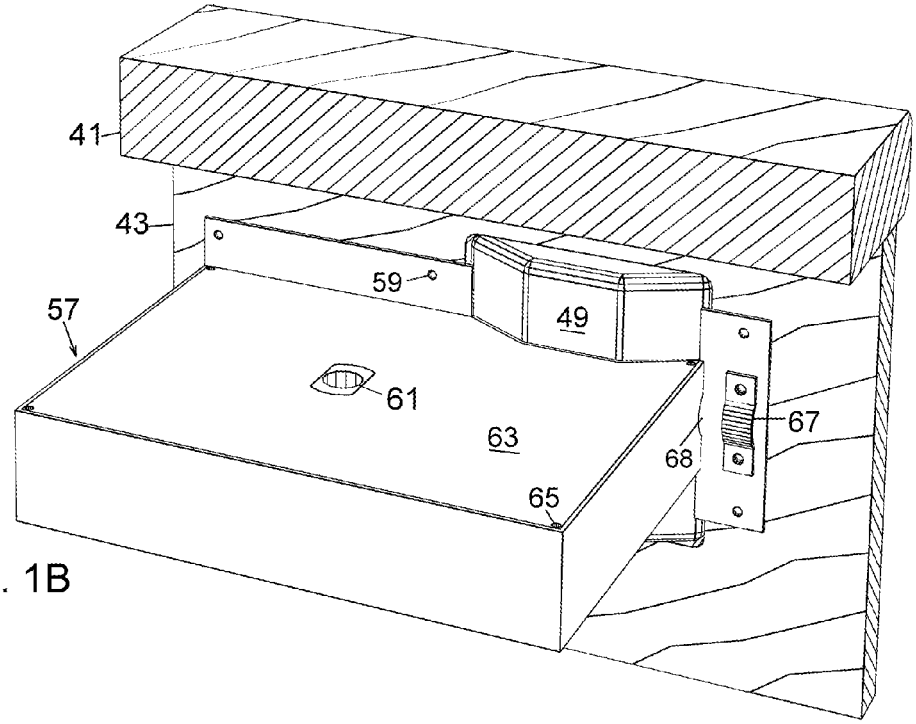

FIGS. 1A and 1B show the recessible task lighting devise mounted. Tabletop edge 41 and sideboard 43 are shown as cross sectional cutaways. FIG. 1A shows lighting source 45 in the recessed position. FIG. 1B is a back view of the lighting devise with its retracting box 57 underneath the tabletop. Lighting source 45 stays flush with the faceplate 49. Push buttons 53 and 55 are also flush with button rings 51. Push button 53 is an electric power, on/off switch. Push button 55 is mechanical and when pressed releases a power-spring mechanism inside retracting box 57.

Faceplate 49 is attached to retracting box 57 with four screws (screws are not shown in drawings) that are driven through four screw holes 71 on the faceplate and four matching screw holes 71A on the retracting box (FIGS. 2-5). Not all holes are visible in a single drawing and only one of the holes is labeled in a figure. Retracting box 57 is mounted on the back side of sideboard 43 with screws driven through six holes 59. Cable fastener 67 is attached to the retracting box 57 with screws that run through holes 67A (FIG. 4B) of the retracting box. The electric line cable (not shown) runs through cable fastener 67 and enters the retracting box through opening 68. Lid 63 is removable as shown by four screw holes 65 making the inside of retracting box 57 accessible for electric connections. Electric line cable must run inside a flexible metallic conduit, or a flexible metallic cable must be used for electrical installations in countertops, tables, and the like in compliance with the electrical safety code and the rules and regulations of the local authority. Cable wires are connected inside retracting box 57 with electric wiring of the device. FIGS. 4A and 4B show there is room available inside box 57 to make electrical connections. There is no need for an extra electric box to connect the device. Retracting box 57 serves as an electric connection box as well, in compliance with electric safety codes of electric installations provided it is large enough, and made of nonflammable and mechanically durable materials. Retracting box 57 can be of plastic, metallic, or other material approved for electric boxes by UL or other equipment testing laboratories.

Figure 2:
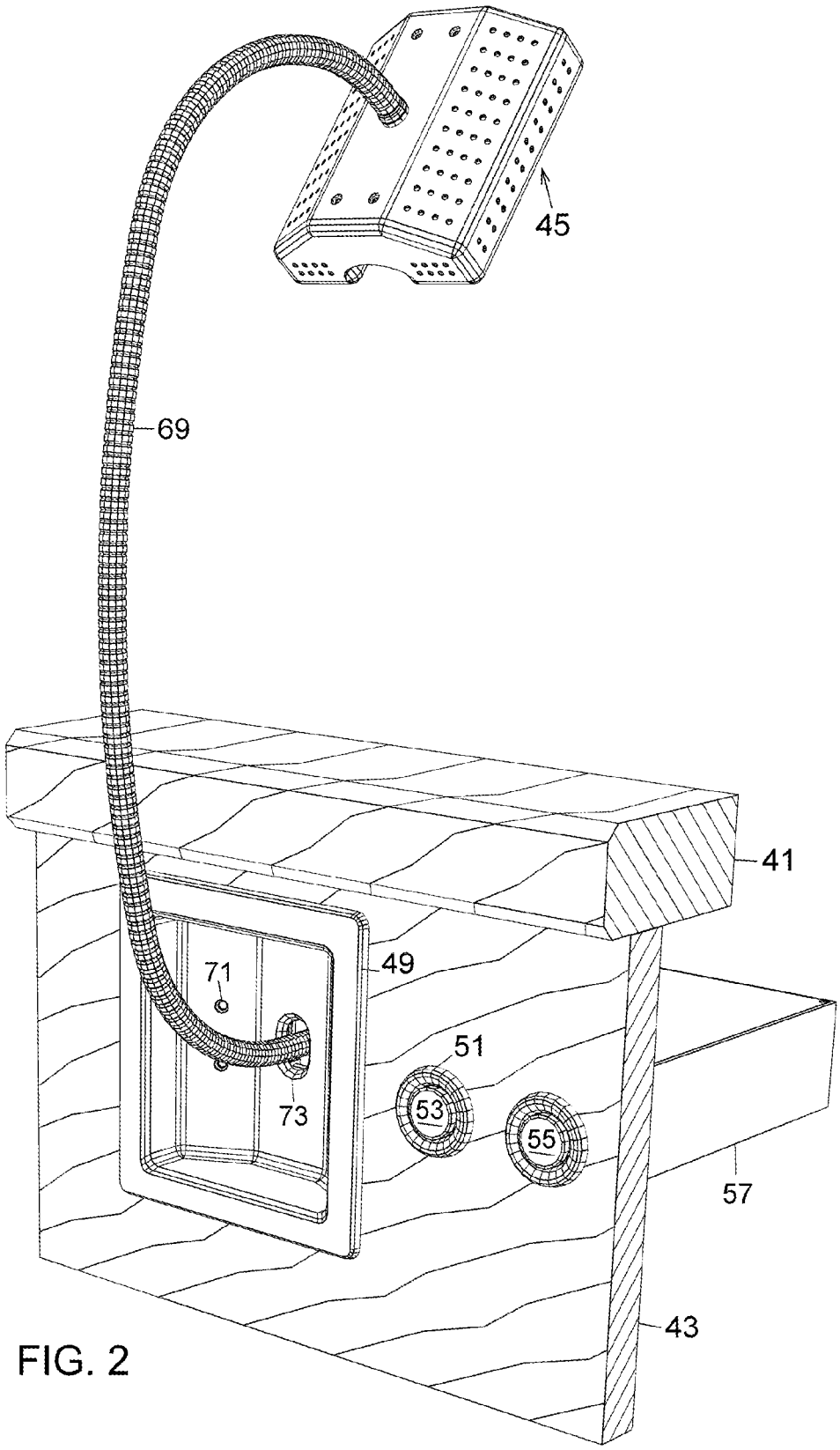
FIG. 2 shows the recessible lighting device with its lighting source pulled out above the tabletop in a task lighting position.

Lighting source 45 is shown pulled out in a lighting position in FIG. 2. Finger handle 47, shown in FIG. 1A, is used to pull out conveniently the lighting source. The user pulls it out directly without pressing any button. The bendable flexible neck—the gooseneck 69 is easily bendable to be wound in a reel inside the retracting enclosure and rigid enough to hold the lighting source in a fixed position above the tabletop. The lighting source can be turned on and off by pressing push button 53. When work is done, user presses push button 55, and lighting source 45 will be retracted towards the recessed position under the table side. As the lighting source approaches faceplate 49, the user snaps it in to the recessed position. The user can do it easily with the same hand pressing the push button.

Figure 3:
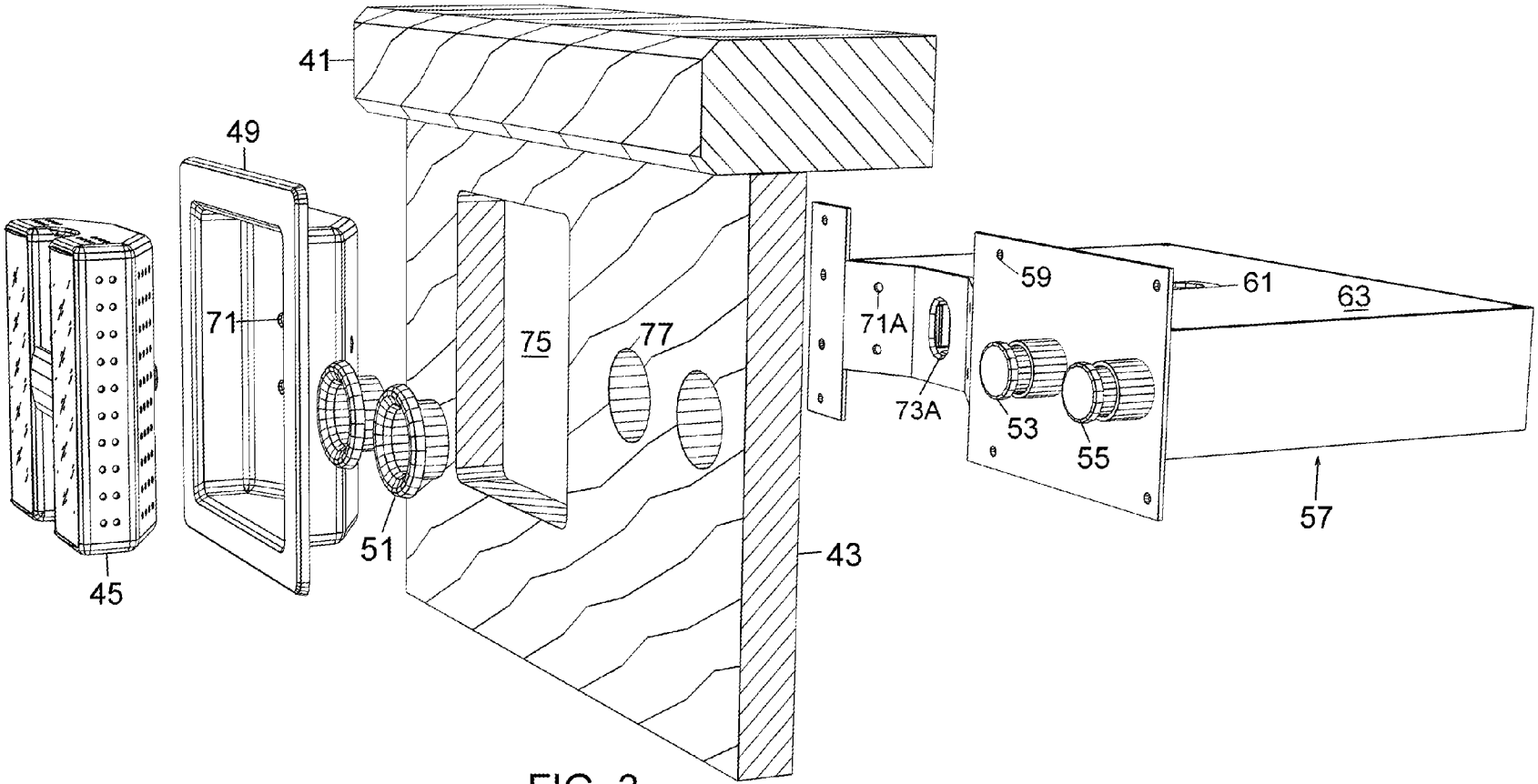
FIG. 3 shows the recessible lighting device of FIG. 1A in an exploded view. The polarized gooseneck is not shown for drawing clarity.

The exploded view of FIG. 3 shows the mounting of the lighting devise onto the table sideboard. Rectangular aperture 75 and circular apertures 77 are first cut open. Lid 63 is removed from retracting box 57. The electric line cable (not shown) is pulled through the retracting box through cable entrance opening 68 after running it first through cable fastener 67. Once electric connections are made, retracting box 57 is aligned to match the sideboard apertures and fixed in position from underneath the table using screw holes 59. The tip of gooseneck 69, shown protruding from box exit aperture 73A (FIG. 4B), is passed through faceplate exit aperture 73 and firmly attached to lighting source 45 using gooseneck connector 115 and tightening nut 115A, shown in FIGS. 13A and 13B. Electric wires coming out of gooseneck 69 (not shown) are connected with LED sources 127 of base 121 through clamping contacts 130 shown as holes in FIGS. 16 and 17. Then lid 119 is screwed in through four holes 117 and 117A. Faceplate 49 is mounted using four screw holes 71 that match holes 71A of the retracting box. Button rings 51 are pressed into circular apertures 77 and the devise mounting is finished.

Retracting Box

Figure 4A:
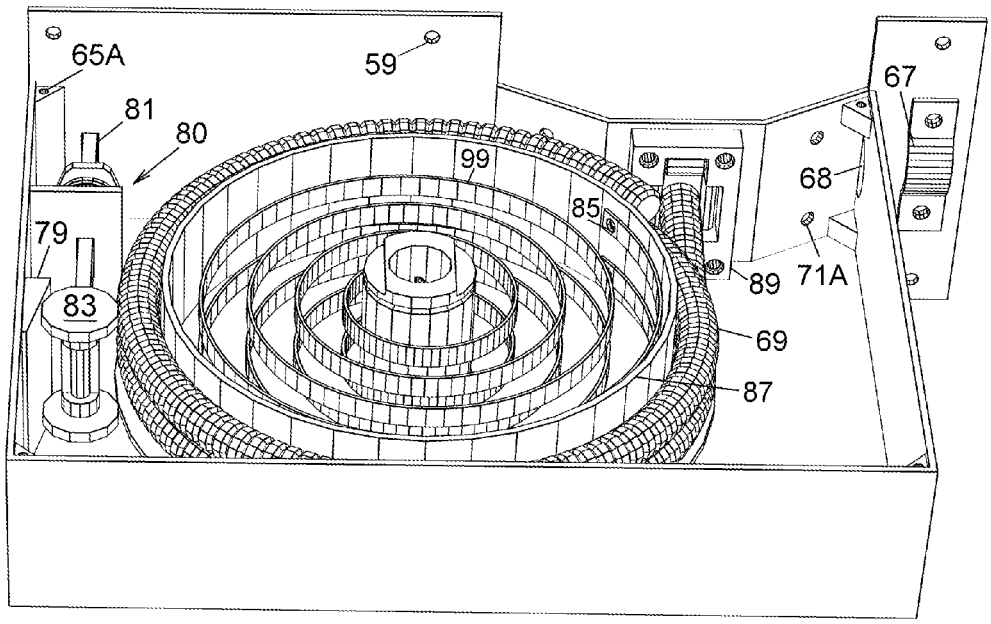
FIGS. 4A and 4B show the retracting box opened up in a back and front view.
Figure 4B:
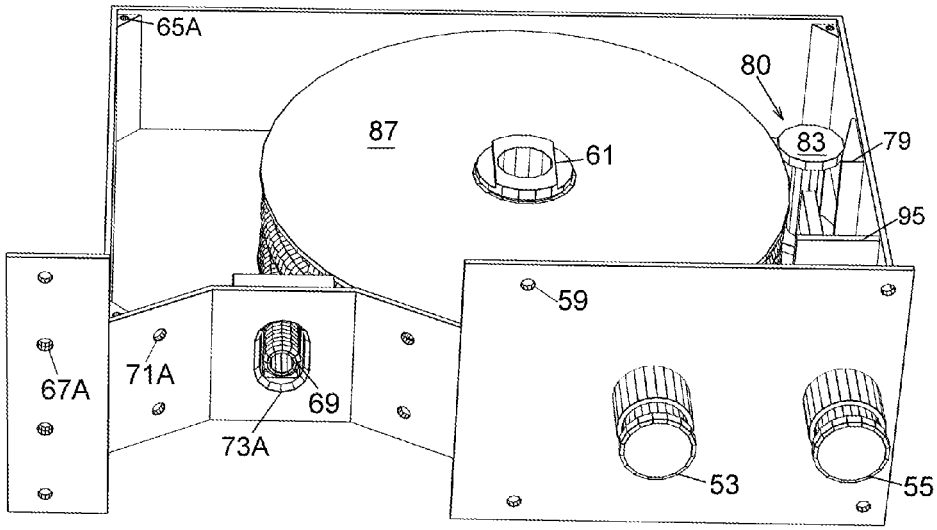

Retracting box 57 houses winding reel 87 and lock-and-release mechanism 80 (FIGS. 4A and 4B). Reel 87 is urged by power springs 99. Winding torque exerted by the power springs is directed towards winding the gooseneck in the reel inside the box. Power springs 99 are mounted with one end on arbor 61 and with the other one on the base of reel 87. Power springs, that are also known as spiral springs or clock springs, are used in conventional applications such as cable-retracting reels, tape measures, and retracting seat belts. Power springs 99 of the preferred embodiments of this invention are used as electric conductors that complete the circuit path. An alloy named 67KN5B is used to make current conducting springs. It reaches its best combination of fairly high elastic properties and good electric conductivity after quenching from 950 degrees Celsius and aging at 600 degrees Celsius. There are also other alloys for conducting springs known to those of ordinary skill in the art. Springs 99 provide two conducting paths that feed electricity to lighting source 45. This eliminates the need for additional rotational sliding contacts to complete the electric circuit. Conducting springs employed in the preferred embodiments of this invention reduce the number of parts by working simultaneously as mechanical springs and electric conductors.

As gooseneck 69 is pulled out, lock-and-release mechanism 80 prevents reel 87 from rolling back, and lighting source 45 is kept indefinitely fixed in the pulled-out position until further action is taken. Rod-guiding support 95 with its rod-guiding opening 81C, and friction pad 79 are the static parts of lock-and-release mechanism 80. These parts are more visible in FIG. 7 where the other parts of the lock-and-release mechanism are removed. Winding of gooseneck 69 is also made visible after the front plate of reel 87 is removed.

Figure 6A:
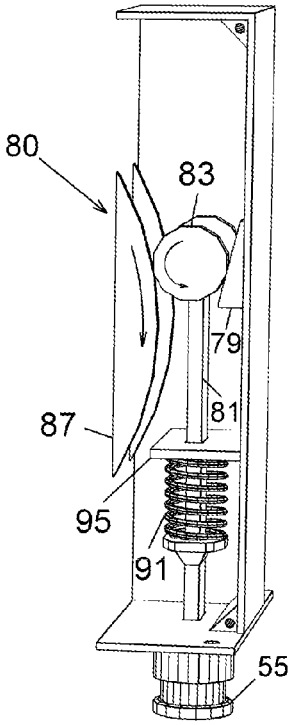
FIGS. 6A and 6B are cut-away views of retracting enclosure that show the lock-and-release mechanism in the locking and releasing position respectively.
Figure 6B:
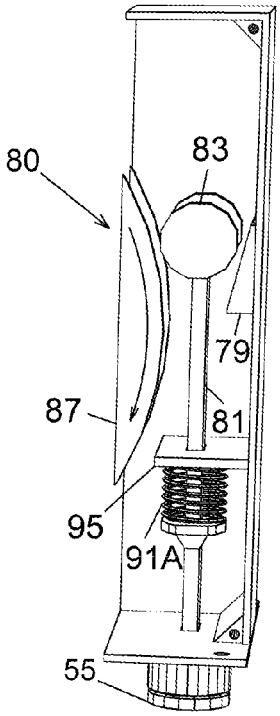
Figure 7:
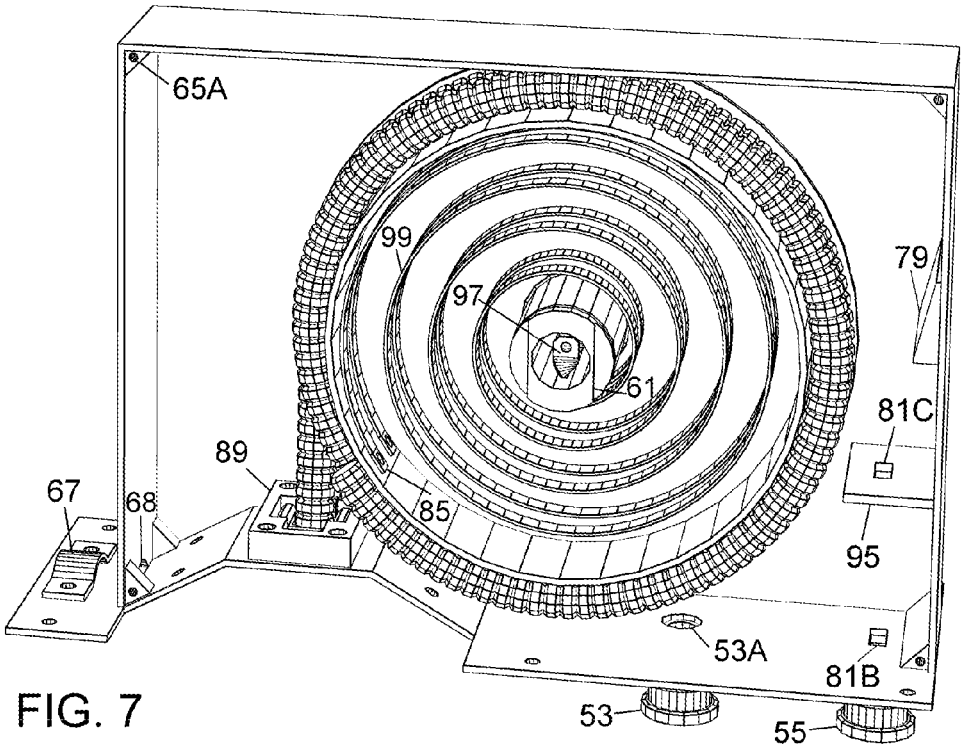
FIG. 7 is an open top view revealing electric contacts and the lock-and release mechanism supports.
Figure 8:
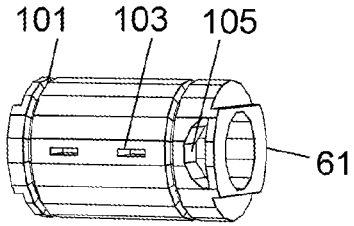
FIGS. 8, 9, 10, and 11 show details of arbor, reel, and conducting springs.

FIGS. 6A and 6B are cut-away views of retracting box 57; they show moving parts and operation of lock-and-release mechanism 80 in two different states. In FIG. 6A, compression coil spring 91 is relaxed, and in FIG. 6B, compressed coil spring 91A is loaded as the user presses pushbutton 55. In FIG. 6A, curved arrows show the directions of rotational tendencies for reel 87 and stopper wheels 83. Reel 87 has the permanent tendency to rotate in the arrow direction driven by loaded springs 99. Stopper wheels 83 squeeze between the rims of reel 87 and friction pad 79. Rewinding back of reel 87 is locked by frictional forces created on the pressed contact surfaces.

As return pushbutton 55 is pressed, stopper wheels 83 move upward and release reel 87, which rewinds pulling back lighting source 45 towards its recessed position. The larger arrow in FIG. 6B shows the rotation of reel 87 after return pushbutton 55 is pressed. As the user's finger is removed from pushbutton 55, compressed spring 91A expands again taking the form of compression spring 91, and stopper wheels 83 drop down again locking the reel rotation. In short, lock-and-release mechanism 80 blocks and releases the rotation of reel 51, while power springs 99 are constantly tensioned towards rotation.

On the other hand, lock-and-release mechanism 80 allows reel 87 to rotate freely in the reverse direction as a user pulls out lighting source 45, provided the user's pulling force overcomes the rewinding torques of spiral springs 99, which are not very large for any user. As the user pulls finger-handle 47, reel 87 rotates in the opposite direction to the one shown by the arrows forcing stopper wheels 83 to rotate also in the opposite direction and become loose. The displacement of stopper wheels 83 out of the squeeze removes their locking action allowing reel 87 to rotate freely. Reel 87 rotates around arbor 61, as internal edges of the reel slide on grooves 101 of the arbor. Gooseneck 69 unwinds, and lighting source 45 is pulled out. Using finger-handle 47, the user can pull lighting source 45 out conveniently from the recessed position to any intermediary position, stop there, and pull it again further easily.

Figure 5:
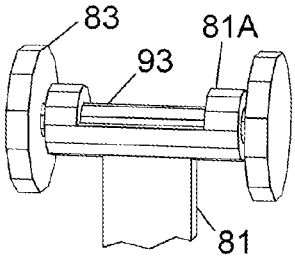
FIG. 5 shows enlarged the lock-and-release mechanism wheels.

Moving parts of lock-and-release mechanism 80 are mounted on rod 81. Axis 93 of stopper wheels 83 rotates on cylindrical holes 81A of rod 81 (FIG. 5). Rod 80 moves back or forth guided by rod-guiding case aperture 81B and rod-guiding support aperture 81C as lock-release button 55 is pressed or released. Compression coil spring 91 returns the rod back to its normal position when user's finger is removed from button 55.

Figure 9:
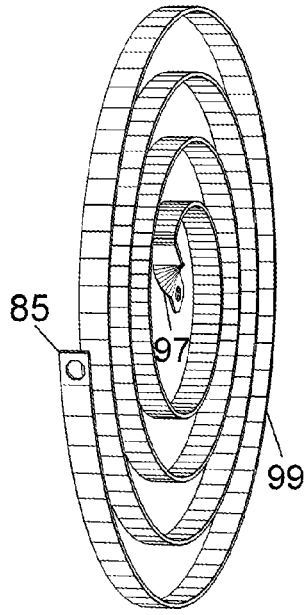
Figure 10:
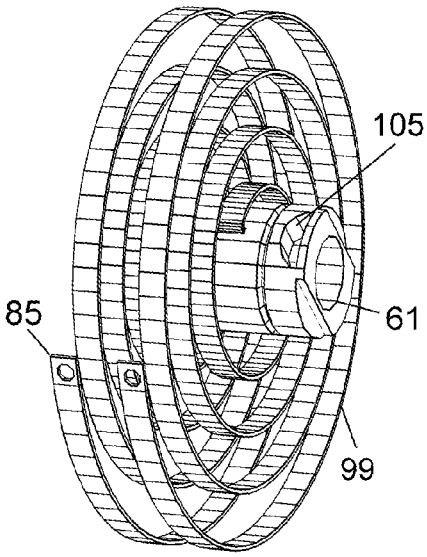
Figure 11:
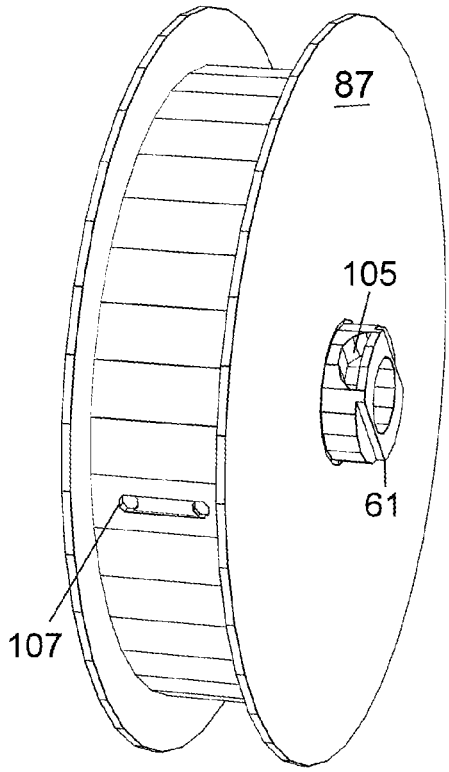
Figure 12:
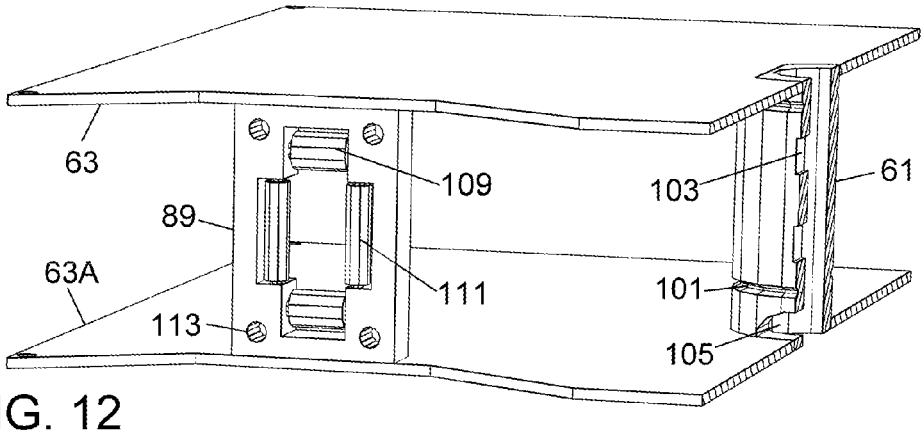
FIG. 12 shows the block of rollers and cross-sectional view of the arbor and plates.

Power springs 99 have inner electric contacts 97 and outer contacts 85, shown in FIG. 9. The inner contacts enter apertures of spring terminals 103 shown if FIG. 8 as it is fastened to arbor 61. The outer contacts 85 are fastened to the base of reel 87. FIG. 10 shows power springs 99 mounted on arbor 61. Electric wires (not shown) enter opening 105 and are connected with contacts 97 inside arbor 61. Electric wiring that runs along gooseneck 69 to lighting source 45 is connected at contacts 85.

Block 89 of guiding rollers (FIG. 12) is mounted inside retracting box behind the box exit aperture 73A. The block has two up-down guiding rollers 109 and two side-to-side guiding rollers 111 that facilitate pulling-out and retracting of gooseneck 69. Block 89 is attached to the retracting box with four screws driven through holes 113. It is mounted between and in contact with top cover 63 and bottom cover 63A of the retracting box. The covers are shown with a cross section along the axis of arbor 61.

Lighting Source

Lighting source 45 (FIGS. 14, 16, and 17) houses two LED sources 127. A plurality of LED-s 125 is shown mounted at the bottom reflecting surface of LED sources 127. Housings 128 enclose driving circuits (not shown) that contain printed circuit boards and control electronics for driving LED-s. LED-s are shown protruding through the reflecting surface of the bottom of housing 128.

Finger-handle 47 is located at the bottom-center of lighting source 45. The use of centrally-positioned finger-handle 47 facilitates the pull-out of lighting source 45. It allows the convenient application of a central force with a one or two-finger and the thumb grip. Finger-handle 47 is also handy in guiding the return of the lighting source to its recessed position.

A plurality of ventilating holes 123 are cut through the inner sides, outer sides, and through the lid of lighting source 45 to allow the convectional flow of air. Free airflow takes away the heat from heat sinks 129 allowing the lighting source to remain cool on the surface.

Figure 19:
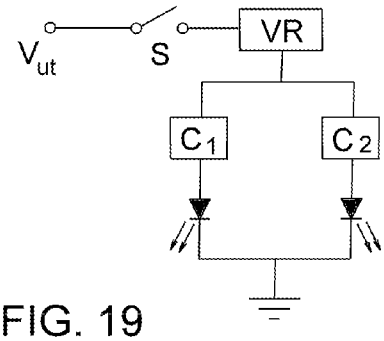
FIG. 19 is the diagram of electric wiring.

FIG. 19 shows the electronic control and power connections of lighting source 45. The recessible lighting device is connected to utility electric line voltage $V_{ut}$. Switch S in schematics is power pushbutton 53 in the drawings, which turns on and off lighting source 45 in the recessed position and in any pulled-out positions. Voltage regulator VR regulates voltage and current values required by LED driving circuit $C_1$ and $C_2$. The two LED light sources 127 in the drawings are shown as two LED symbols in the schematics of FIG. 19. Heat sinks 129 are attached at the top of LED sources 127. They remove the relatively small amount of heat dissipated by LED-s and driving circuits $C_1$ and $C_2$. Heat sinks have direct contact with driving circuits allowing for the transfer of heat while providing electric insulation. Lighting source 45 is kept cool on the surface by free air convection through ventilating holes 123 on the top, sides, and in the middle part.

Figure 13A:
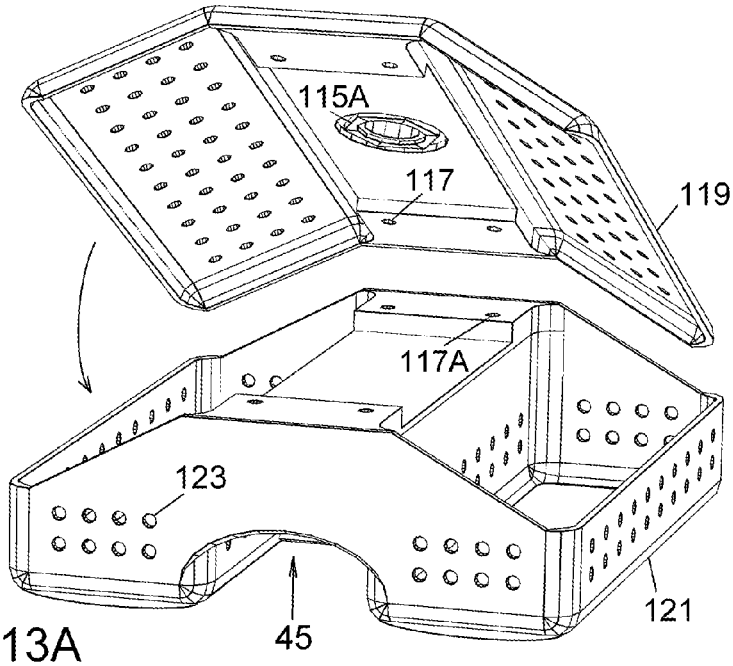
FIGS. 13A and 13B show the lighting source case in an exploded and a top front view respectively.
Figure 13B:
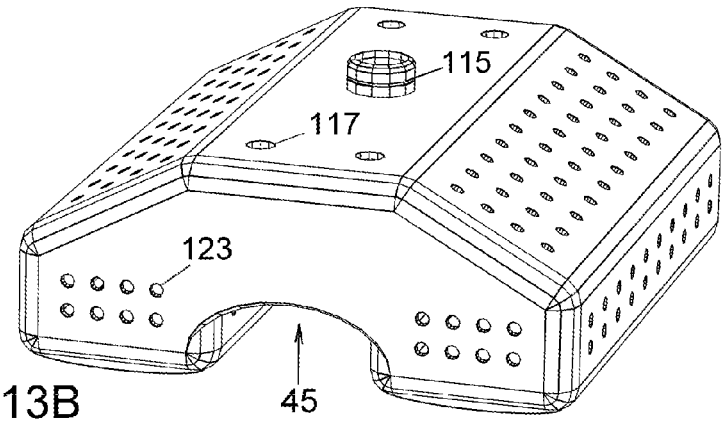
Figure 14:
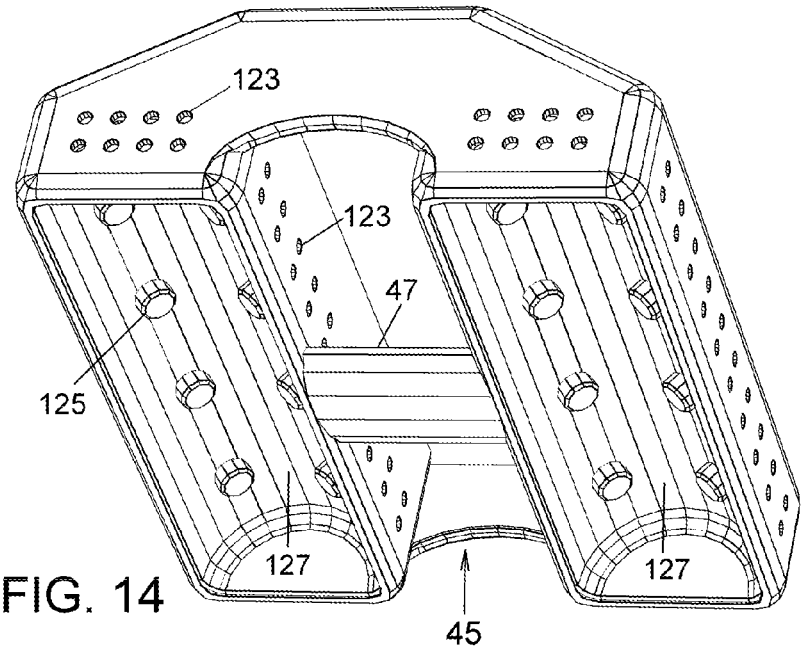
FIG. 14 is a bottom view of the lighting source with light diffusers removed to reveal the LED-s.
Figure 15:
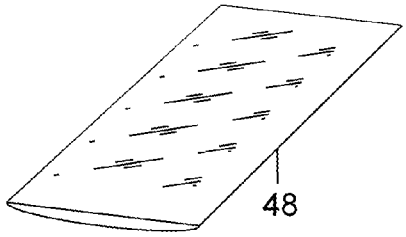
FIG. 15 shows one of the two light diffusers from above.
Figure 16:
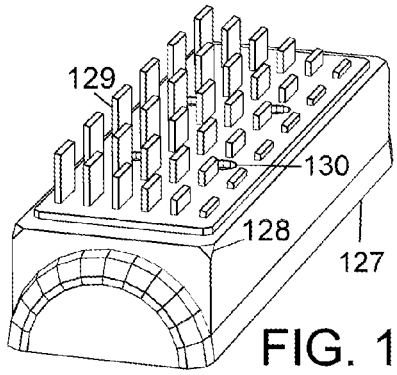
FIG. 16 shows a top view of the LED package mounted on the right side of the lighting source
Figure 17:
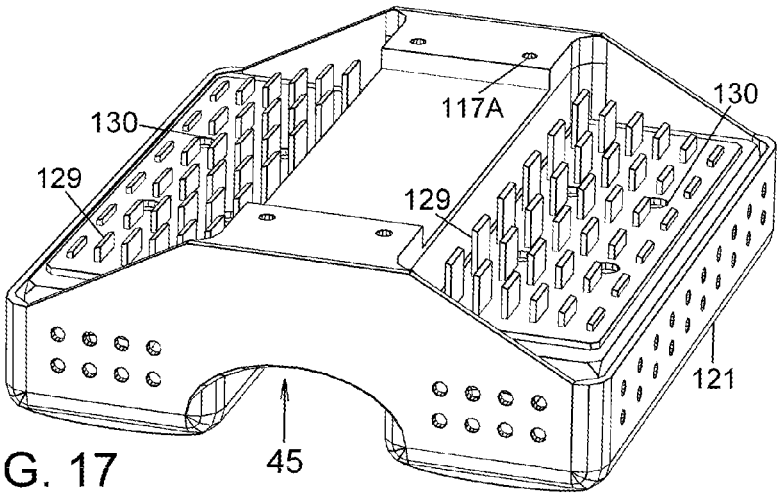
FIG. 17 shows the lighting part with the lead removed to reveal the positioning of the lighting sources and their heat sinks inside the lighting part.

Light diffusing lenses 48 cover and protect LED-s while focusing and diffusing light outward. The elongated shape of lenses 48, their material, and curvatures of their top and bottom surfaces, determine the sizes of light cones. Any of the three above factors can be modified to satisfy different customer preferences. FIG. 13A is an open view of lighting source 45, shown empty to reveal its interior design. Lid 119 is fastened to the base of lighting source 45 with four screws. Screw holes 117 of lid 119 match screw holes 117A of base 121. Tightening nut 115A fastens the end of gooseneck 69 (not shown) with bottom of lid 119. Wires (not shown) from gooseneck 69 run through nut 115A and are connected to LED light sources 117 in base 121 through clamping contacts 130 shown as holes on the heat sinks 129 in FIGS. 16 and 17.

Lighting source 45 draws its power from the utility line. It does not need a battery pack. Lighting source 45 is also shock-proof and very durable. Unlike lamps that use light bulbs, this LED lighting source has no parts that can easily break. Another advantage of LED-s is their very long life expectancy. Unlike light bulbs which need to be replaced fairly often, LED-s require little or no replacement.

Circular Gooseneck—Special Case of the Vertically Polarized

Figure 25:
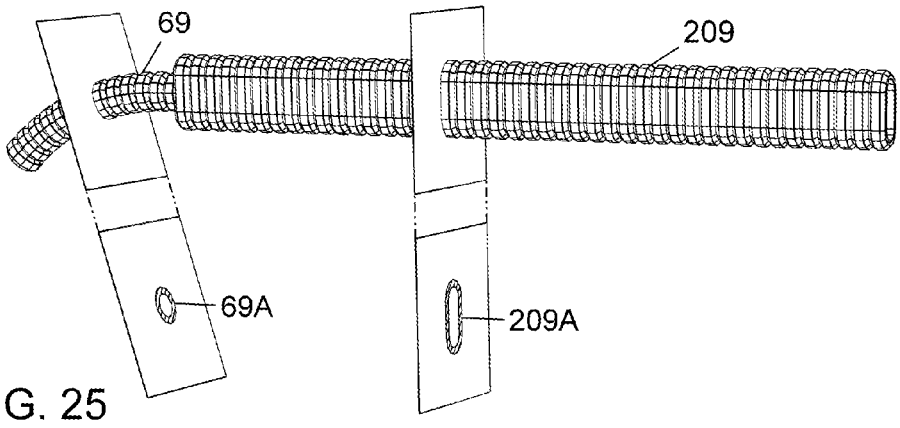
FIG. 25 shows generically the combination of two goosenecks used in the second and third embodiments of this invention.
Figure 26A:
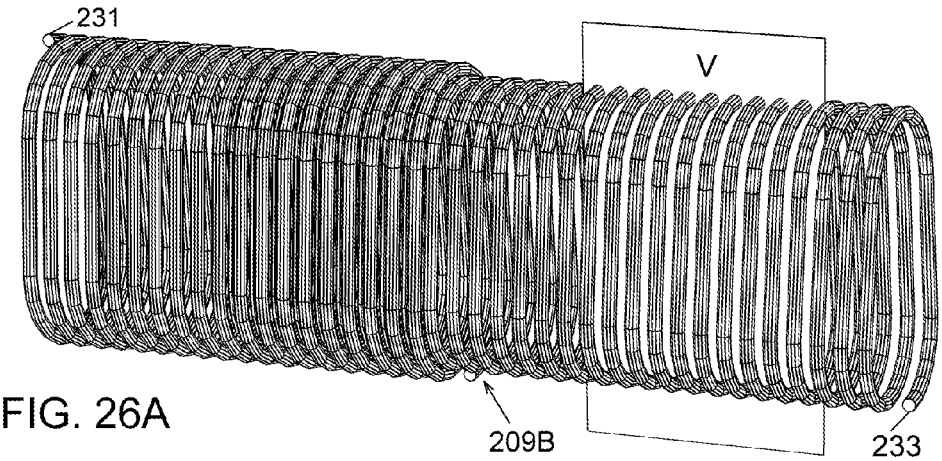
FIGS. 26A and 26B show the coil structure of a polarized gooseneck.
Figure 26B:
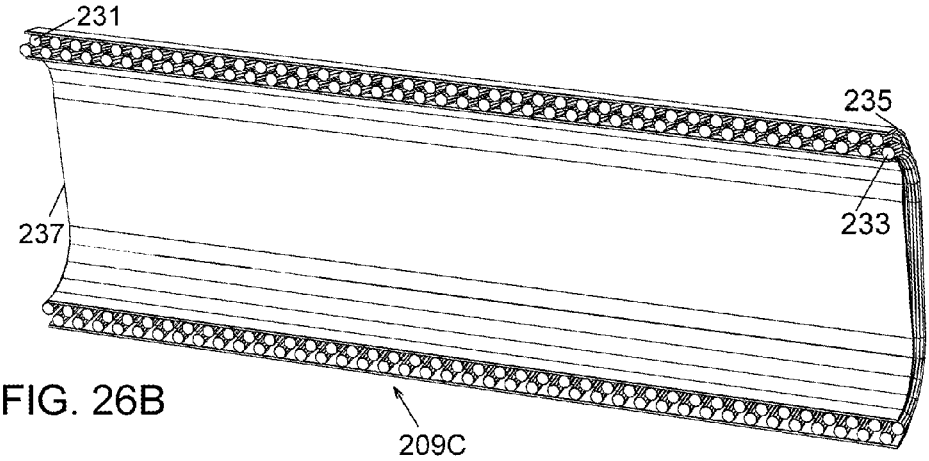

Gooseneck 69 (FIG. 18A) has circular cross sections perpendicular to its length. Gooseneck 69 is a special case of polarized gooseneck 209 (FIGS. 25 to 26B). The polarized gooseneck is characterized by the vertical dimension of its cross section that is longer than its horizontal dimension, the height is larger than width. The height-to-width ratio of the vertically polarized gooseneck shown in FIGS. 25 to 26B is 2/1. In general, the ratio can vary in a broad range from 1/1 to 5/1 or even larger, but the low limit is 1/1. Circular gooseneck 69, employed in the first embodiment, has the low limit ratio of 1/1.

The circular symmetry makes gooseneck 69 equally bendable in all directions. Although bendable, the gooseneck can hold the lighting source fixed in one position provided the horizontal displacements of the lighting source from the recessed location are limited to substantially one foot, but the exact limiting value depends on other characteristics of the gooseneck: its structure, cross-sectional diameter, etc.

Figure 18A:
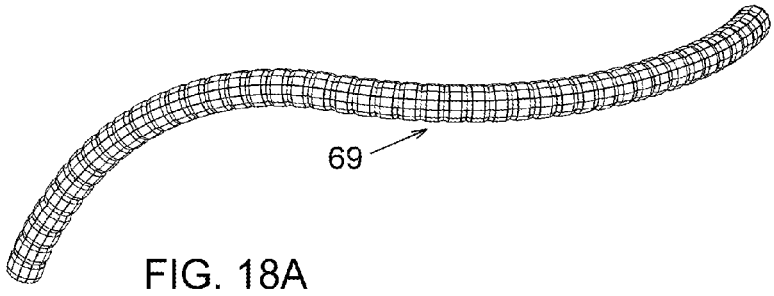
FIGS. 18A and 18B show respectively the generic view and the internal coil structure of the gooseneck employed in the first embodiment.
Figure 18B:
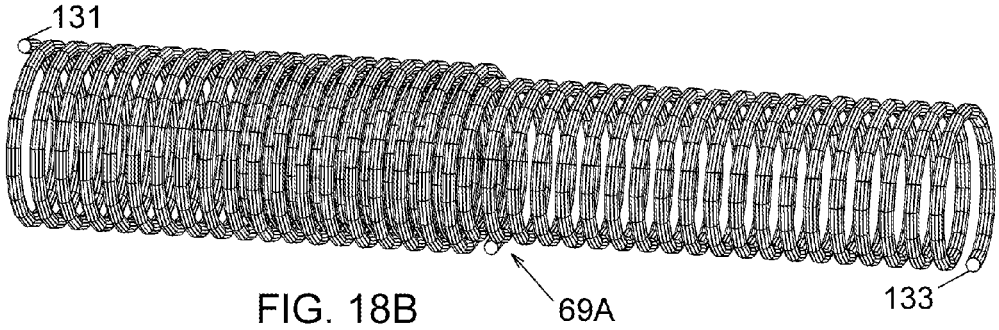

The internal structure of gooseneck 69 has two coils of circularly wound wire. The inner surface of the larger coil is in touch with the outer surface of the smaller coil, enclosing the latter. Segments of two enlarged gooseneck coils are shown in FIG. 18B, where coil 131 embraces coil 133. The gooseneck is finished with a plastic or rubber coating (not shown). A coil has bendability, which for a single coil is inseparable from elasticity. The coil easily bends, but as soon as it is released, it returns back to its initial shape. A single coil does not preserve its bended shape once the bending force is removed. The two-coil structure eliminates the single-coil elasticity and creates a bendable gooseneck that preserves the given form. Internal forces of static friction at points of contact between the outer surface of smaller coil 133 and the inner surface of larger coil 131 do not allow coil surfaces to slide. Without surfaces sliding, a two-coil gooseneck will not return to its initial form after bending. Forces of static friction will preserve the gooseneck's new form indefinitely. The gooseneck gains certain rigidity due to static friction and retains its shape. To force the gooseneck to change form once again, a bending effort of the user's hand or the bending torque of the retracting box is required.

Furthermore, a gooseneck with a certain degree of rigidity can hold a moderate amount of weight at one end and still preserve its given form. The combination of two coils gives the gooseneck a holding capacity. The more rigid a gooseneck is, the more weight it can hold. Its rigidity is determined by its coil diameters, clearance gaps between coils, coil winding directions, type of coil wire, wire thickness, etc. Various degrees of rigidity are obtained by manipulating the above factors. The chosen gooseneck must be bendable enough to be wound in retracting box 57, and rigid enough to hold lighting source 45 at a fixed position. The lighter in weight is the lighting source and the smaller is its accepted limit of lateral displacement from the gooseneck's exit point, the less rigid the gooseneck can be. This is advantageous in designing the recessible lighting device. The gooseneck can also be lighter in weight, smaller in thickness, and more easily woundable in a reel. The retracting box can also be smaller in size.

While the vertically polarized goosenecks for the second and third embodiment of the device have to be principally new designs based on specifications shown later in this disclosure, its special case, the circular gooseneck of the first embodiment, is already available from gooseneck-manufacturing companies, which accept customer-specified orders. The circularly goosenecks may differ in sizes, materials used, etc. The weight of the lighting-source and its horizontal displacement limit are to be specified by the ordering customer and submitted to the manufacturing company. There are many circular gooseneck manufacturers that can provide the required weight and horizontal displacement. However, the main challenge for manufacturers is the gooseneck bending. The bending limit is defined as the smallest radius of curvature that the gooseneck can safely tolerate at bending. The gooseneck bending limits vary among goosenecks of different structures and different manufacturers. The higher the quality of the gooseneck, the smaller is its bending radius of curvature, and also the smaller is gooseneck's thickness and weight.

Operation

The recessible lighting device is controlled as a conventional lighting fixture in its recessed position on the side of a table. It can be turned on and off by pressing power pushbutton 53. However, the advantageous function of the device is its tasklighting over the table.

The user can grip finger-handle 47 with one or two fingers and the thumb of one hand and pull out lighting source 45 from the side of the table. Pushbutton 53 turns the lighting on and off in any location. The user can stop pulling the part at any intermediary location and resume pulling it until a preferred lighting position over the table is reached. This feature allows the user to concentrate the light as needed by directing it toward and bringing it close to the object intended to be viewed. Turning the lighting source away from user's eyes reduces stray light. Bringing the lighting source near the object increases viewing light. As a result, the freedom of device positioning improves the quality of lighting. In addition, the ample range of controls that the recessible lighting device provides, coupled with its convenience and non-intrusiveness, makes the user feel in control while adjusting positions and directions, and has positive psychological effects.

Lighting source 45 is retractable to its recessed position after use. By pressing return pushbutton 55 the lighting source retracts gradually towards the recessed position on the side of the table. Return pushbutton 55 is kept pressed as the lighting source approaches the faceplate. The user may have to adjust the lighting source's orientation before snapping it into the recessed position. Operations of other embodiments are similar to the operation of the first one.

Uses and Advantages

The recessible task lighting device of the first embodiment can be especially useful for lighting the tabletop of small tables in small rooms or tight spaces, where it can free appreciable tabletop area. It can be used for reading, using the keyboard, or doing other work. Being positioned in the space between the eyes of the viewer and the observed object, the lighting is confined to the viewing area being nonintrusive to other people in the room (e.g. a sleeping child, people in tight watercraft spaces, etc). The tabletop area is left free for other objects as the lighting source in use is positioned above the table as opposed to on the table. Yet another advantage is that the direction of lighting is adjustable easily. Adjustment can be as simple as the back-of-the-hand push, or a light elbow push. Probably, the most valuable advantage of the device is that after use it is recessible in the side under the tabletop and out of the way with the press of a button. The recessible lighting device of the first embodiment can be installed also in the side of countertops or outdoors in the side of a barbeque grill, for example, to light the cooking area.

Second Embodiment—FIGS. 20A to 26B

Figure 20A:
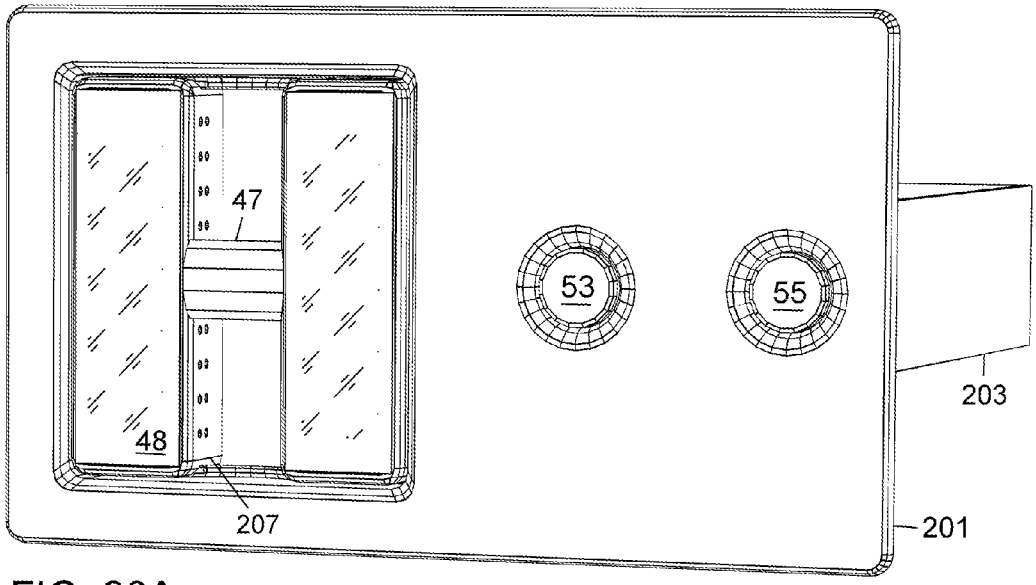
FIGS. 20A and 20B are front and back views of the second embodiment of the recessible lighting device.
Figure 20B:
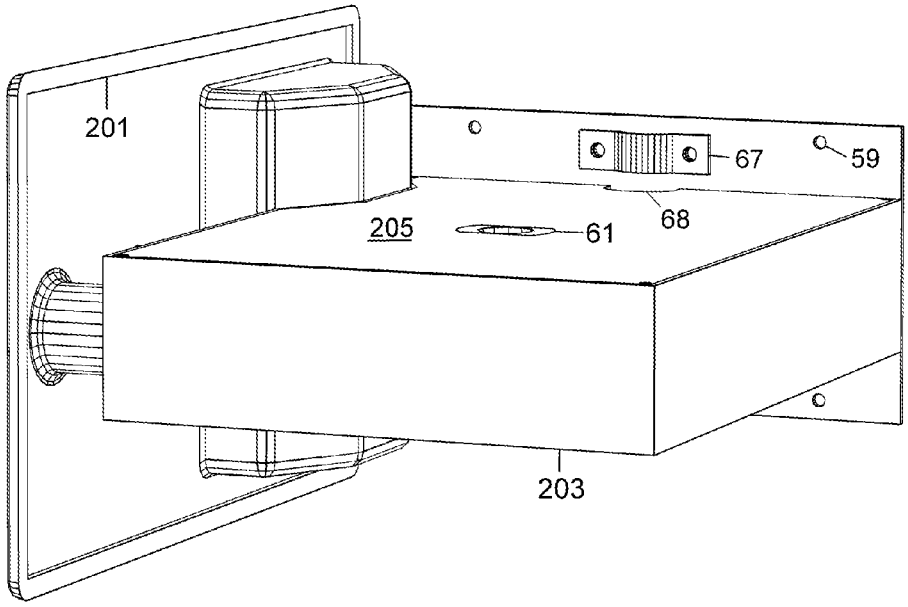
Figure 21:
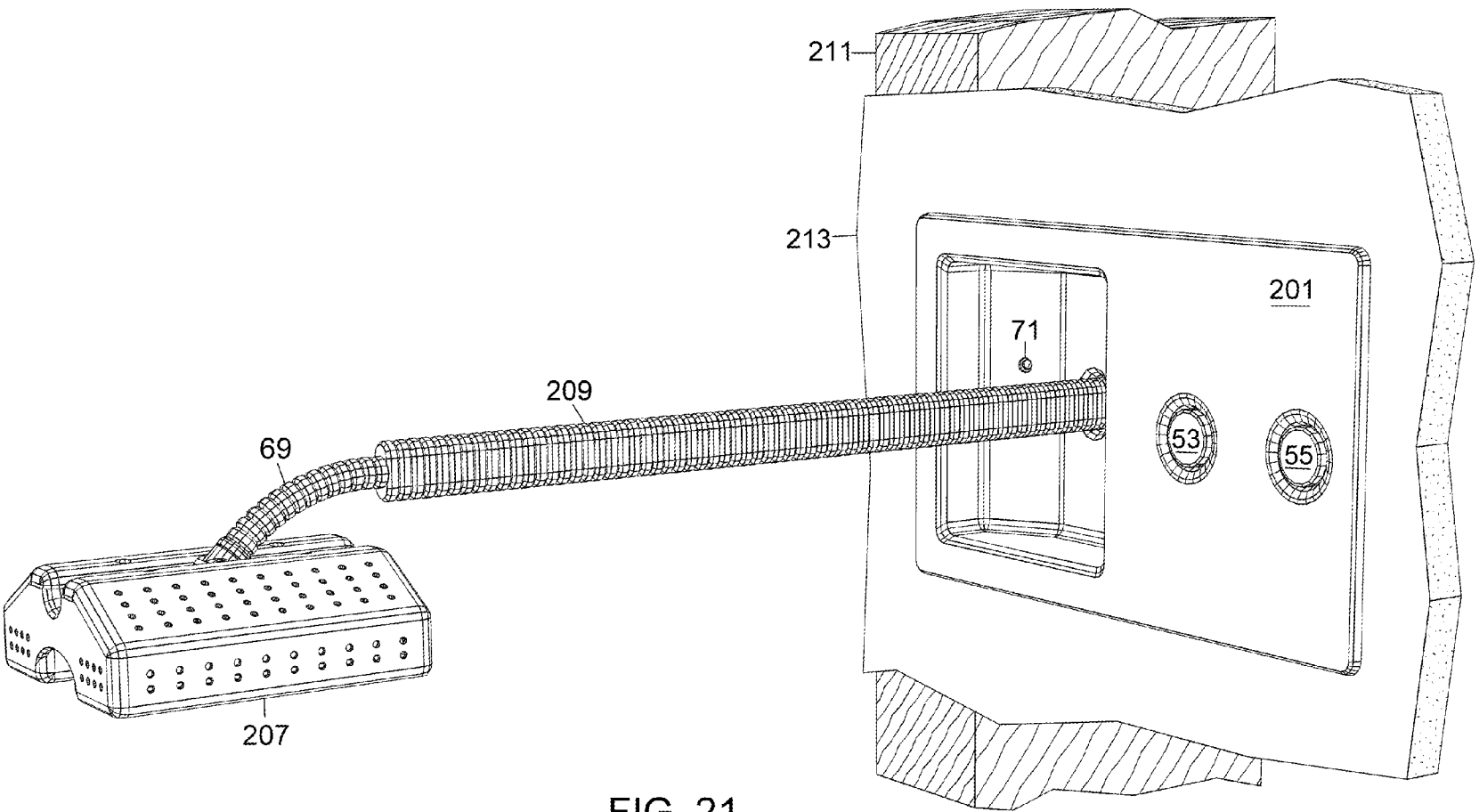
FIG. 21 shows the stud-wall mounting of the second embodiment with its lighting source pulled out and pivoted.

The second embodiment of the recessible task lighting devise is mountable on a wall adjacent to a table. It can be mounted to a front wall or to a side wall. The mounting location depends on how the table and the sitting person are positioned relative to the walls. The lighting device is mounted within the hand reach of a sitting person. The user can pull out conveniently the lighting source from the wall to a lighting position above the tabletop. FIGS. 20A and 20B are respectively the front and back views of the lighting device. FIG. 21 shows the lighting source pulled out of the wall.

The wall mounted embodiment differs from the table mounted one. The most significant modification is the use of a new gooseneck type that has double-bendability. The new gooseneck is easily bendable on the horizontal plane. The horizontal bending makes the gooseneck woundable in the reel inside the wall and adjustable above the table. On the other hand, the gooseneck is hardly bendable on the vertical plane. The resistance to vertical bending makes the gooseneck capable of extending away from the wall without sagging while holding the lighting source above the table.

The second modification is made in the lighting source, the upper part of which is modified to accommodate a pivotal connection with the gooseneck. The third modification is made in the faceplate, which is extended to include the push-buttons. The forth modification is made in the retracting box, which is adopted for screw attachment to a wall stud. Its mounting plate is on the side rather than the front of the retracting box. Electric cable enters the retracting enclosure directly from the wall stud.

Figure 22:
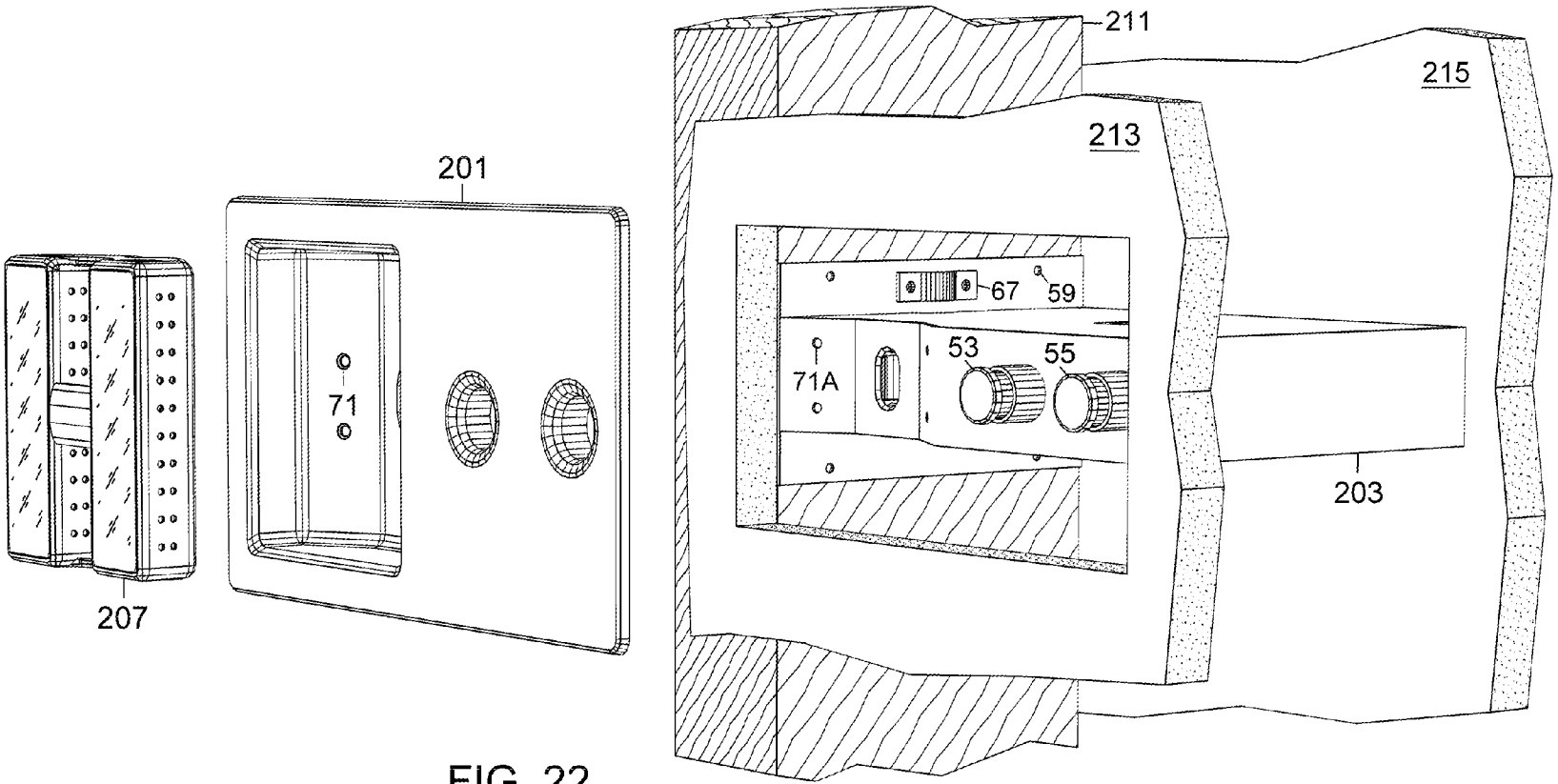
FIG. 22 is an exploded view of the stud-wall mounted second embodiment. The gooseneck is not shown for clarity.

Polarized gooseneck 209 that has a vertically elongated cross section is combined with gooseneck 69 that has circular cross section. Lighting source 207 is pivotally attached to gooseneck 69 using T-nipple 223 shown separately in the exploded view of FIG. 24A. Faceplate 201 covers the mounting rectangular opening cut in front drywall 213. Retracting box 203 is firmly attached to wall stud 211 using four screw holes 59. Electric line cable (not shown) comes from above along wall stud 211 and enters cable entrance 68 after passing through cable fastener 67. The cable can come also from bellow and enter retracting box 203 through a knockout entrance and a corresponding cable fastener (not shown) located on the bottom part of the retracting box. FIG. 22 shows an exploded view of the lighting device with retracting box 203 attached to wall stud 211 in the space confined by two drywalls 213 and 215. The depth of the retracting box matches the distance between the two drywalls. Screw holes 71 of faceplate 201 match holes 71A of retracting box 203. The gooseneck is not shown in FIG. 22.

Retracting Box

Figure 23A:
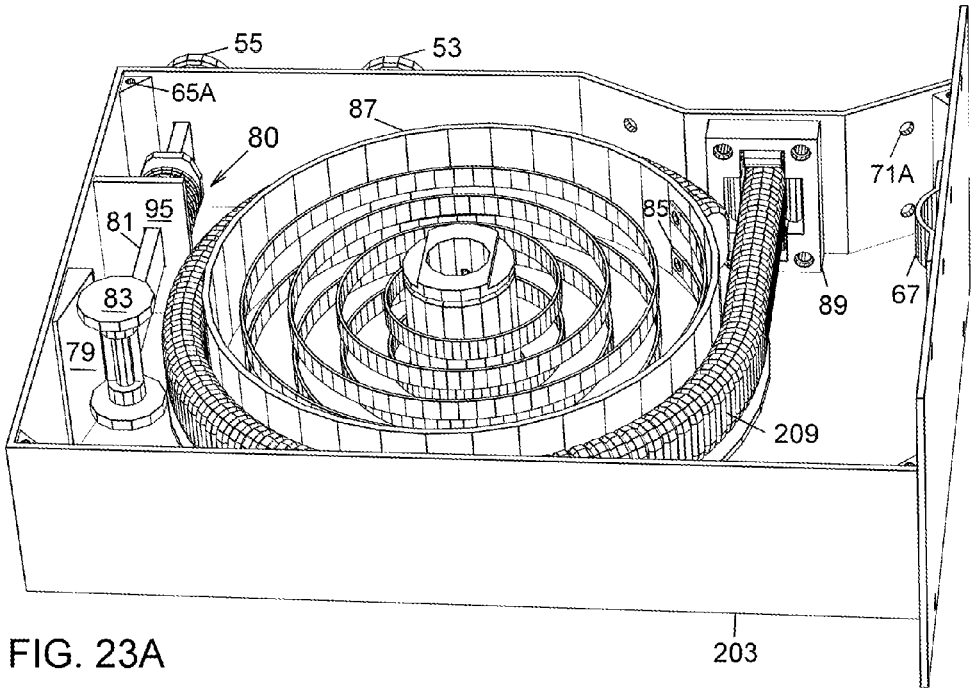
FIGS. 23A and 23B show the opened retracting boxes of the second embodiment in back and front top views respectively.
Figure 23B:
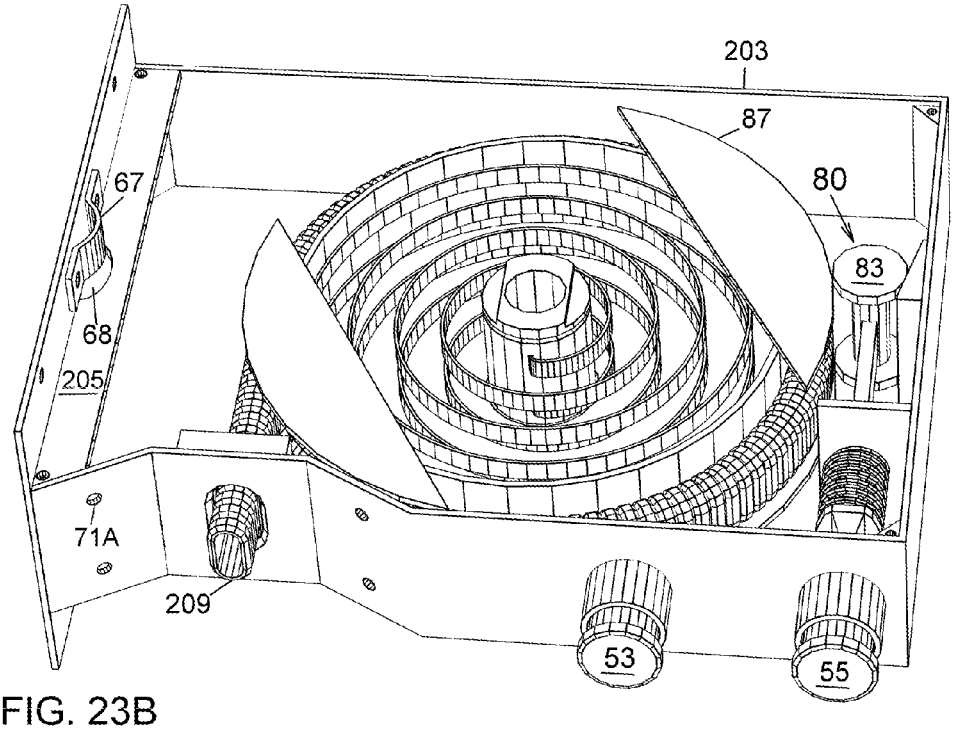
Figure 24A:
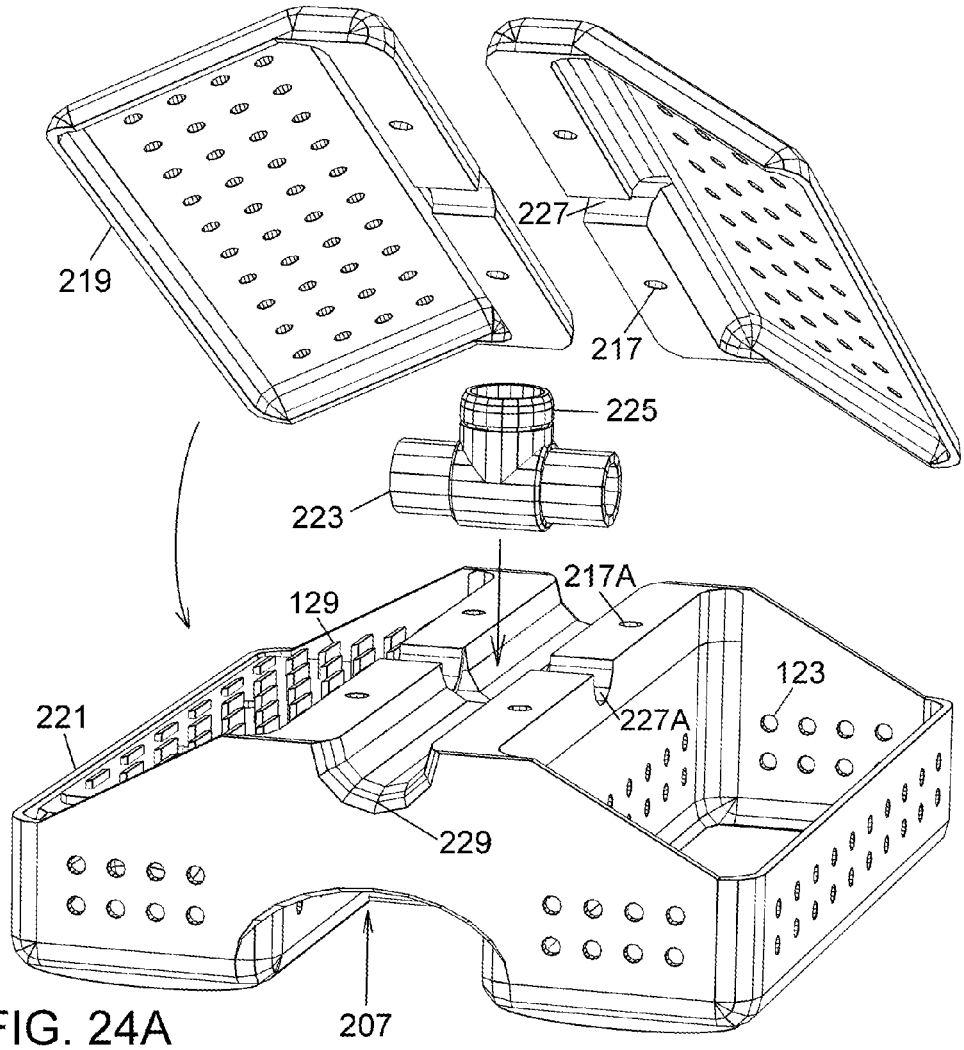
FIGS. 24A and 24B show the lighting part of the second embodiment in an exploded view and in a top front view respectively.
Figure 24B:
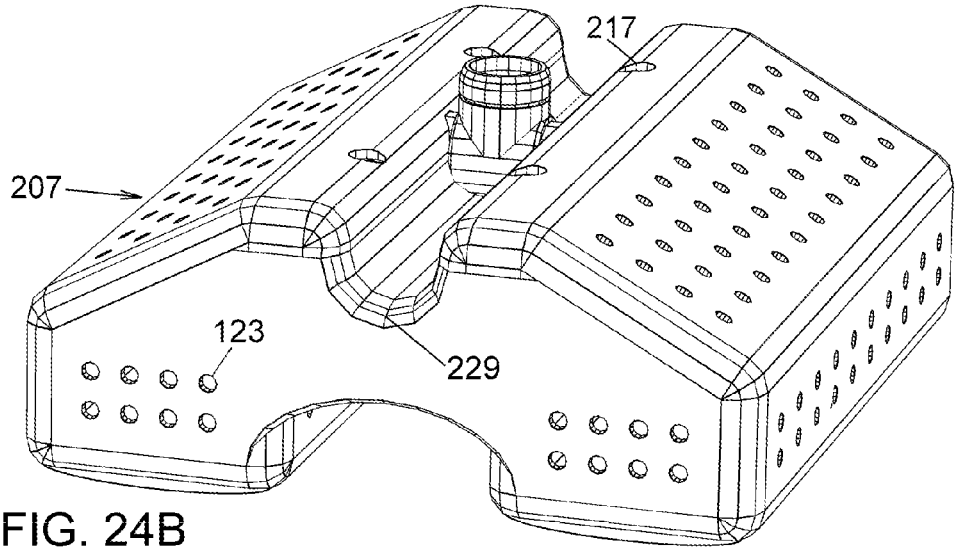

Retracting box 203 houses winding reel 87 and lock-and-release mechanism 80 (FIGS. 23A and 23B). The upper side of reel 87 and upper cover 205 of the retracting box are shown in cross sections. Upper cover 205 is fastened to the retracting box through screw holes 65A. Notice the location of cable fastener 67 and cable entrance 68 on the side of retracting box 203. In FIG. 23B are also visible the all four screw holes 71A and the profile of double bendability gooseneck 209.

Lighting Source

Lighting source 207 (FIGS. 24A and 24B) has pivotal attachment to the proximal end of the combinations of goosenecks 209 and 69. The pivotal connection increases orientation adjustment of the lighting device over the tabletop or other working area. T-nipple 223 fits into the cylindrical channel created by base groove 227A and lid groove 227. T-nipple 223 is made tubular so that wires (not shown) run inside it and feed power to the LED-s in lighting source 207. Long groove 229 allows rotation of the lighting source on both sides of the pivoting direction by accommodating circular gooseneck 69 along the length of the groove. Gooseneck tightening nut 225 connects firmly gooseneck 69 with T-nipple 223. Lid 219 is attached at the top of base 221 of the lighting source using screw holes 217 that match holes 217A in the base. Heat sink 129 is shown on the left side of the lighting source, whereas the right side is left empty for visibility inside the lighting source. Except for the design changes that provide pivotal connection with the gooseneck, lighting source 207 is identical to lighting source 45 of the first embodiment.

Vertically Polarized Goosenecks

FIG. 25 is a generic view of the combination of polarized gooseneck 209 with circular gooseneck 69. Cross section 209A of polarized gooseneck 209 is vertically elongated, in contrast with cross section 69A of gooseneck 69 that is circular. FIGS. 26A and 26B show the structure of gooseneck 209. FIG. 26A shows the coil structure 209B of gooseneck 209 made of two vertically elongated coils of wire enclosing each other. Outer coil 231 encloses inner coil 233. The coils are in physical contact along the entire length. FIG. 26B shows the longitudinal cross sectional view of internal structure 209C of gooseneck 209 along the vertical plane V that cuts the gooseneck into two equal parts. Outer coil 231 and inner coil 233 are coaxial, and the entire coil structure is covered with outer coating 235 and inner coating 237. The coatings are made of elastomeric material. Any elastomeric materials like silicon rubber or other similar materials can be used for coatings. The turns are extended more along the vertical direction than the horizontal one. The shape of coil turns resembles an ellipsis with the larger axis along vertical direction. The vertically elongated coil structure suppresses the vertical bending ability of polarized gooseneck 209 while preserving the horizontal one. As a result, when retracted horizontally for relatively long distances (e.g. 2 to 4 feet), the gooseneck will not sag.

As above mentioned, the polarized gooseneck is characterized by the vertical dimension of its cross section that is longer than the horizontal dimension; in short, the height is larger than width. The polarized gooseneck shown in FIG. 25 has the height-to-width ratio 2/1. The ratio can be larger, up to about 5/1, when longer horizontal distances, up to about 3-4 feet, must be covered by the gooseneck carrying the lighting source over the working area.

Uses and Advantages

The recessible task lighting device of the second embodiment can be pulled out of its recessed mounting in the wall and used to light a tabletop. It can be pulled out as far as needed to find the best lighting position (about 1 to 4 feet from the wall horizontally). Also, it can be pulled out from a wall enclosure, or any other enclosure installed on a side support, to light the laptop of the user. The lighting source is hold up in the air above the tabletop or laptop, letting the area free for other objects. It can be used for reading, using the keyboard, or doing other work. Being positioned in the space between the eyes of the viewer and the observed object, the lighting is confined to the viewing area, the eyes of the viewer are protected, and the lighting source is nonintrusive to other people in the room. The position and direction of lighting are easily adjustable. After use, lighting source is recessible to the wall with the press of a button. It can be very useful in tight quarters of small rooms. The device can be mounted in side walls at a wall height that is around one foot above the cover blankets of the beds. It can be used for single or bunk beds found in cruise liners, children's summer camps, etc. Furthermore, the side-vehicle-enclosing walls are usually made thick for safety purposes. The wall thickness provides enough available space to mount the recessible lighting device inside the vehicle's walls from where it can be pulled out over the laptop of the occupant. Mounting inside the arm rest on the side of the occupant's seat is another option.

Third Embodiment—FIGS. 27A to 31

Figure 27A:
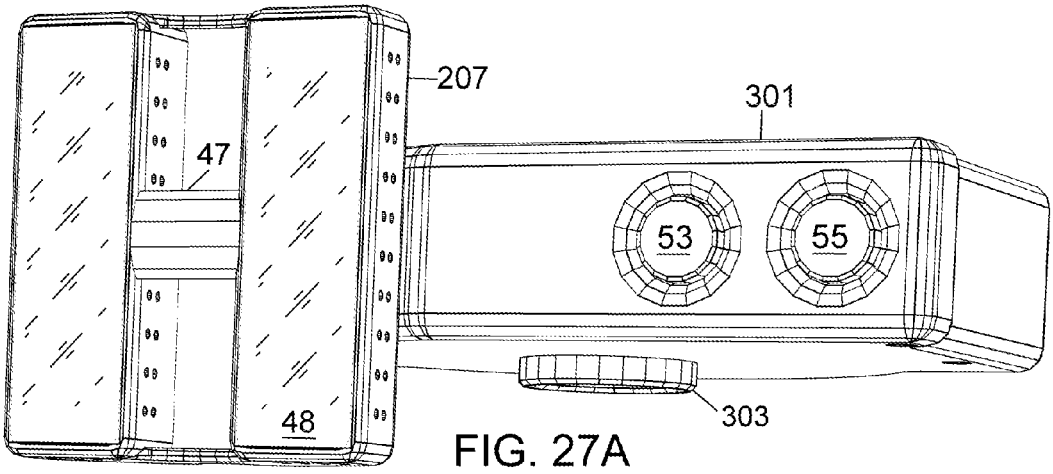
FIGS. 27A and 27B are the front and back-top views of the third embodiment of the recessible lighting device.
Figure 27B:
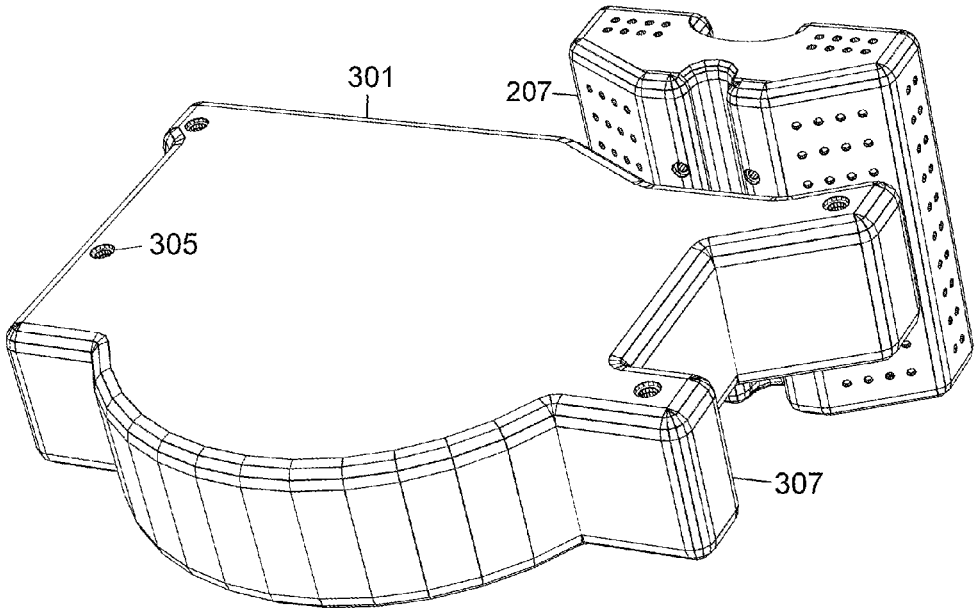
Figure 29:
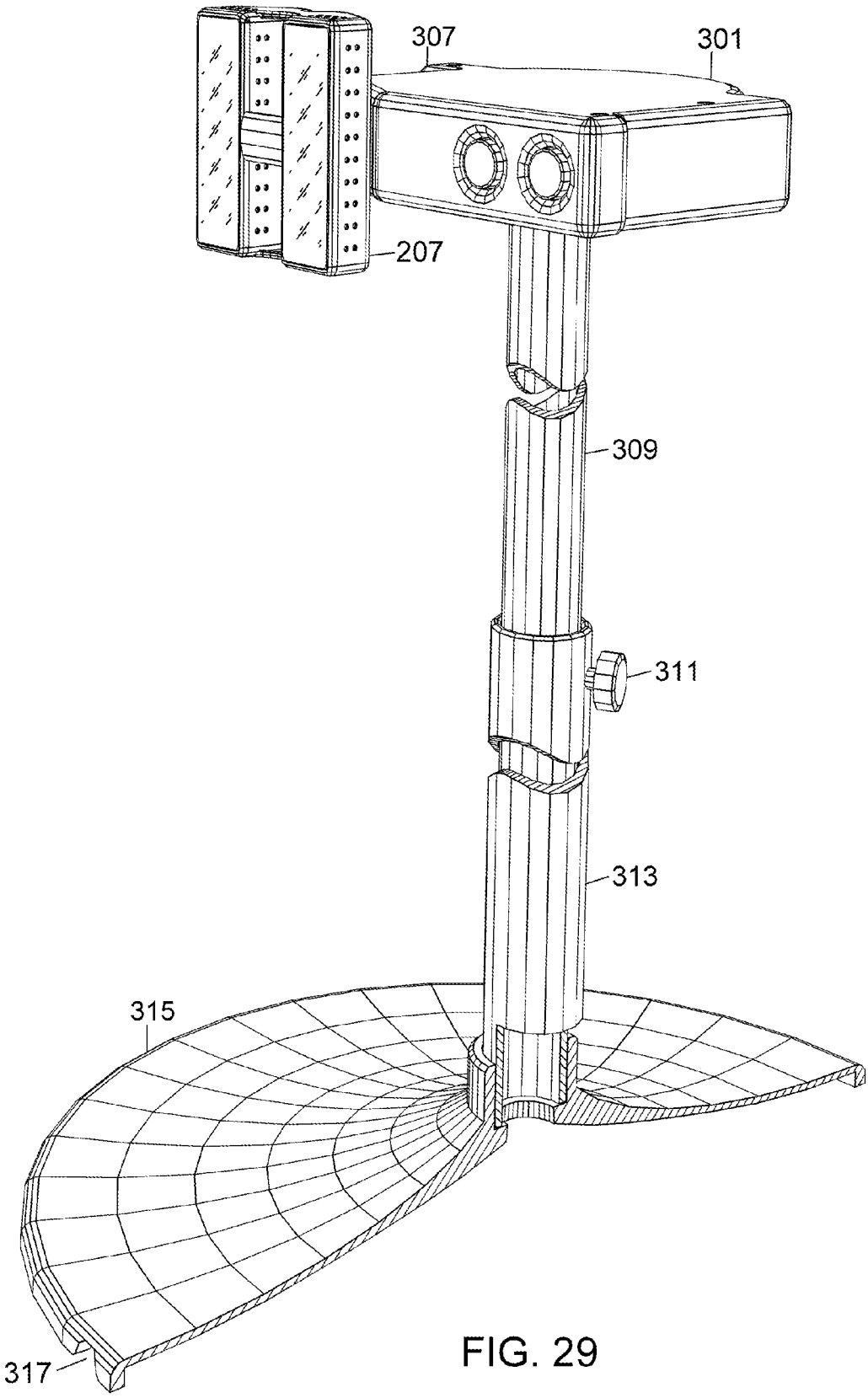
FIG. 29 shows the third embodiment of the recessible lighting device mounted on a telescopic pole stand.
Figure 30:
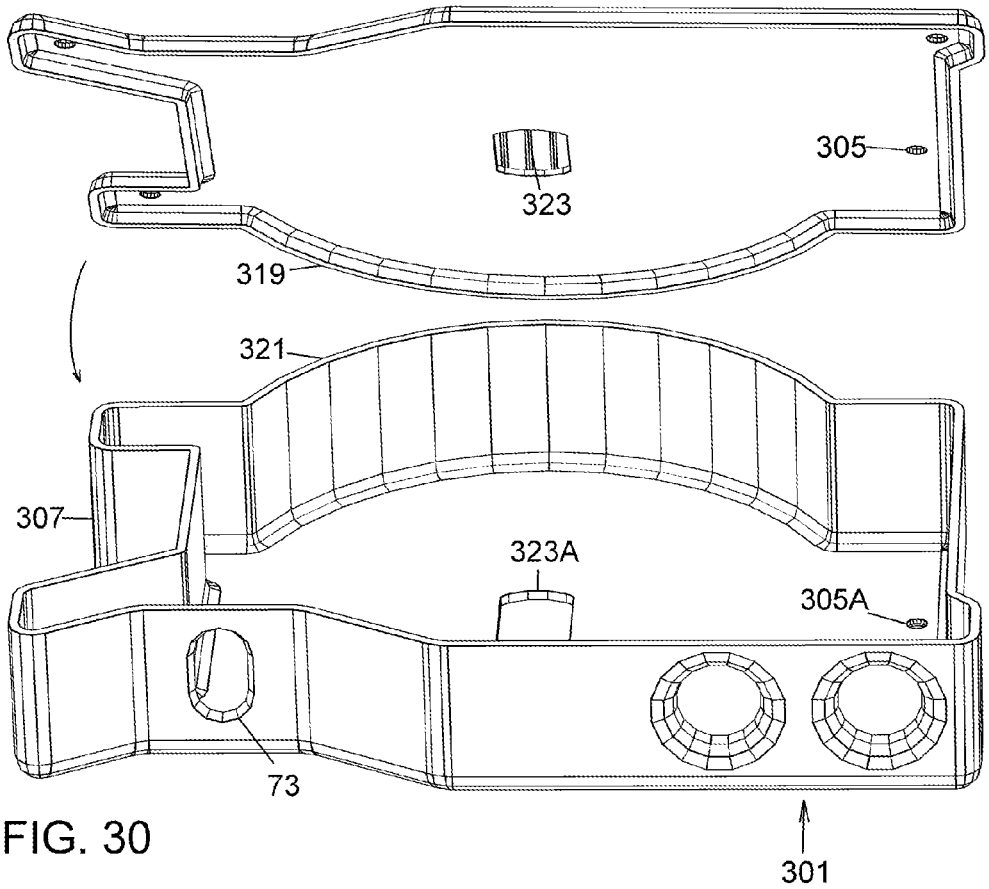
FIGS. 30 and 31 are respectively an exploded view of the retracting case and a top view of the retracting enclosure with the case top lead removed revealing the inside parts.
Figure 31:
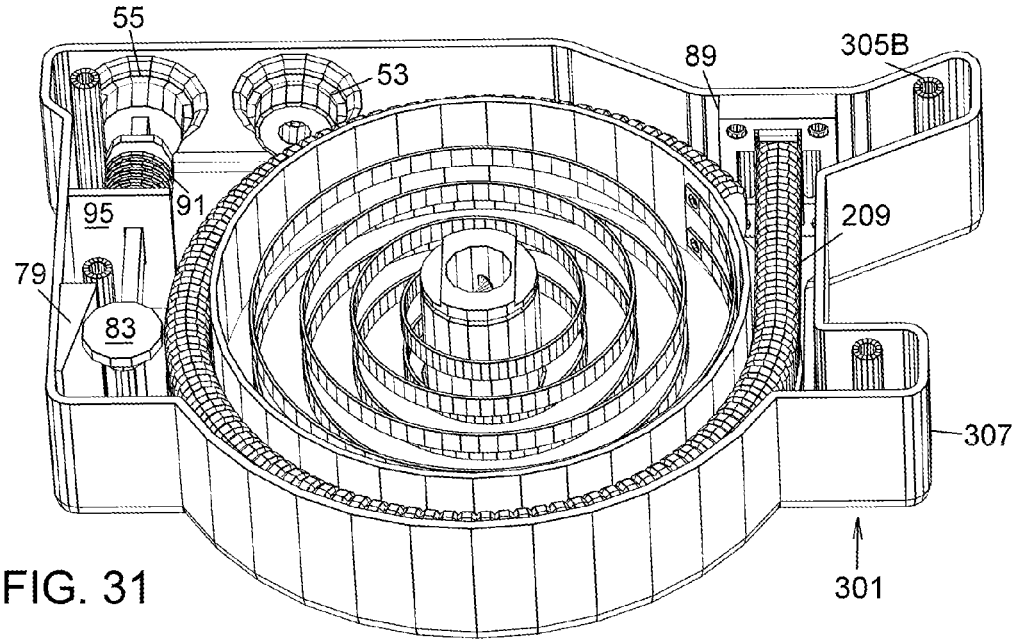

The third embodiment of the recessible task lighting device is mountable on a pole stand. FIGS. 27A and 27B are respectively the front and back views of the pole-mountable lighting device. In the third embodiment, the retracting box and the faceplate (existing separately in previous embodiments) are incorporated in casing 301. In addition, the third embodiment introduces palm-handle 307 with casing 301. Palm-handle 307 is used to push casing 301 with the palm of the hand when lighting source 207 is pulled out. It facilitates creating a counterbalancing torque with one hand while pulling finger-handle 47 with the other. Connection nut 303 is used to mount casing 307 to the top of pole 309 shown in FIGS. 28 and 29. Four screw holes 305 are used to firmly attach lid 319 to base 321 of casing 307 using four lid-screwing tubes 305B (FIGS. 30, 31). Arbor-bottom engaging opening 323A is a through aperture, while arbor-top engaging indent 323 is not, so that it conceals electric wiring connections inside arbor 61.

Figure 28:
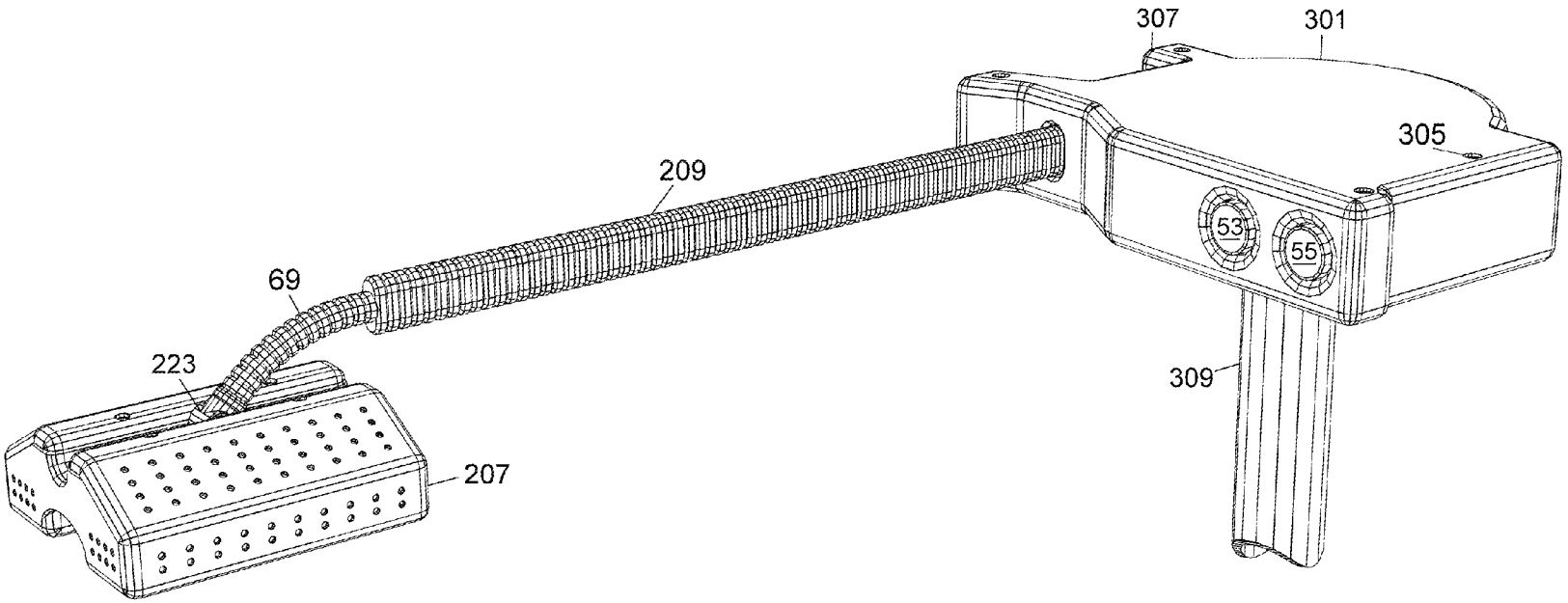
FIG. 28 shows the pulled out and pivoted lighting source with its retracting enclosure fixed at the top of a pole stand.

FIG. 28 shows the lighting source 207 pulled away from casing 301 into a deployed lighting position. FIG. 29 shows a pole stand with internal tube 309 telescopically engaged with external tube 313. Clamping knob 311 serves to choose the initial height of the lighting device. Small height adjustments of lighting source 207 above the lighted area can be made at the proximal end of the extended arm by bending vertically gooseneck 69. Base of the pole stand 315 has cord-entrance opening 317 for the electric cord (not shown) that runs inside the tubes of the pole stand.

Operation

The recessible lighting device is controlled as a conventional lighting fixture in its recessed position on the pole stand. It can be turned on and off by pressing power pushbutton 53. However, the most advantageous function of the device is shown when it is pulled out over the working area.

The user grips finger-handle 47 with one or two fingers and the thumb of the right hand and pulls the lighting source out while pushing palm—handle 307 with the palm of the left hand. The device shown in the drawings is right handed. In another version, the device can be manufactured also as left handed by positioning the lighting source and the palm handle on the other side.

Pushing palm-handle 307 with the palm of the hand is necessary so that the total forces and lever arms are balanced and the pole stand does not rotate or tip over when the pulling force is applied on finger-handle 47. The rest of the device operation is the same with other embodiments.

Uses and Advantages

The recessible task lighting device of the third embodiment can be pulled out of its recessed attachment on the floor or pole stand and used to light a working area. It can be pulled out a certain distance horizontally (e.g. 2 to 4 feet) to find the best lighting position above the observed area. The combination of two goosenecks provides versatility of source adjustment and precision positioning in almost any location and direction above the working area. The lighting source is positioned in the space between the eyes of the viewer and the working area. The cones of light are directed towards the observed object, the eyes of the viewer are protected, and the quality of lighting is improved. The device can be helpful to doctors and dentists as a highly adjustable lighting source. The recessible lighting device takes less room than lighting sources mounted on conventional wall-mounted articulating arms or floor stands. Furthermore, the gooseneck combination employed by the invention allows fine, continuous, and convenient adjustments of the lighting source that are superior to those of the articulating arms of the prior art.

The third embodiment of the lighting device is also useful as an alternative to lighting devices that doctors and dentists wear on the head. The head-wearable lighting devices have obvious drawbacks. Besides the headlamp, the doctor has to wear a hair cover, and frequently a viewing magnifier or other instrument. Holding two or more objects on the head for many hours of work is inconvenient. Furthermore, the headlamp is accompanied with batteries that the doctor must hold somewhere on its body and electric wires running from the batteries to the headlamp. Other headlights use optical cables that 'tie' the doctor to the cart of light-generating equipment.

INDUSTRIAL APPLICABILITY

The recessible task lighting device of the present invention improves the quality of lighting. It can be positioned at the most suitable location for the user. Cones of it light can be moved easily in any selected direction for the best view. The eyes of the viewer exposed only to the back (dark) side the lighting source are protected from direct light, while the lighted area gets the full power of the source. The recessible task lighting device of the present invention lets the surface of the working area free for other objects. The lighting source that is hold fixed in a lighting position up above the table does not use any surface on the working area, letting it free to the user for other objects. After use, the lighting device is recessible to a location out of the way of the user. Anytime the user may need it again, it is always there. The user needs only to pull it out of the recessed location. The easy direction and position control of the lighting device allows the cones of lights to be focused only on the working area of one person. The recessible task lighting device is not intrusive to other people in the room that may not want lighting.

Other Embodiments

The gooseneck and the other main parts of the device are expected to have variations. For example:

While the second and third embodiments of the disclosure combine two pieces of polarized gooseneck with ratios 2/1 and 1/1, as an alternative, an application might have several pieces or segments of polarized goosenecks of different polarization ratios attached linearly to one another.

Still other applications may employ a polarized gooseneck with polarization ratios that, instead of changing abruptly from one segment to another, can vary gradually along the entire length from the highest value (e.g. 4/1 at the distal end at the exit of the retracting enclosure), to the lowest value (e.g. 1/1 at the proximal end of the gooseneck where the lighting source is attached).

In yet another application, the polarization ratio may be constant throughout the gooseneck's length. For example, the first embodiment of this invention employs a polarized gooseneck of constant polarization ratio 1/1 throughout the gooseneck's length. This special case is suitable only for relatively small horizontal pull-outs from the exit of the retracting box at the recessed location.

Instead of winding reel 87, a compression power spring may be employed to retract the gooseneck inside the table, wall, or pole stand without winding it in a reel. Instead of electric-conductive power springs 99 used in this disclosure, non-electric power springs in combination with sliding electric contacts can be employed. Sliding contacts are in wide use for cable-winding reels; they are shown in numerous patents, and are known to those of ordinary skill in the art.

Instead of using non-electric power spring(s) that drive the gooseneck winding as suggested above, an electric motor can be used. Instead of the lock-and-release mechanism described in the specification, other mechanical mechanisms like those used for controlling cable winding reels, safety belts, or tape measures can be employed. Some lock-and-release mechanisms are activated by pulling down the cable with a short jolt, eliminating the need for a return pushbutton to activate retracting enclosure. The above mechanisms are all well known to those of ordinary skill in the art.

Instead of the mechanical lock-and-release mechanism controlled by a mechanical pushbutton as described in the specification, an electro-mechanical equivalent that employs a ferromagnetic relay and an electric switch is a known replacement that can be used. Additional features can be added to the retracting enclosure, such as a mechanism that secures constant torque, or constant speed as the gooseneck is retracted.

Lighting source 45 can have various shapes, such as rectangular, oval, circular etc.; it can have one, two, three or more LED packages; it can be built using various materials, such as plastic, hard rubber, carbon fiber, or carbon composite, which are well known to those of ordinary skill in the art, and chosen based on properties, cost, and customer preferences.

Finger-handle 47 can be replaced with two or more indents, one on each side of the lighting source. Indents can accommodate two or more user fingers, one on each indent. The user can grip the lighting source with the thumb in one indent and the pointing finger and/or others fingers in the others to pull it down. This is suitable for lighting sources with one LED package, which are narrower than those with two or more. Other forms of finger-handle designs can be used based on the size of the lighting source and customer preferences.

LED-s 125 (FIG. 14) can be replaced with other types of high-efficiency light sources, such as cold cathode tubes, halogen sources, etc. Driving circuits inside housing 128 (FIG. 16) can be replaced by driving circuits installed inside the retracting box or enclosure to reduce the weight of the lighting source.

A constant pulling force of the wound gooseneck holds firmly the lighting source in its recessed location on the retracting enclosure. In addition, a variety of snap-on mechanisms, well known to those of ordinary skill in the art, can be used to reinforce the holding firmly of the lighting source on the recessed location. The above variations, and other obvious ones not mentioned, are within the spirit and teachings of this invention.

Special Technical Features

The recessible task lighting device has special technical features that provide functionality and offer convenience of operation. While there are variations that create different embodiments, all embodiments of this invention have in common one or more special technical features.

This invention has gone through a couple of inventive steps. By examining the surroundings of a sitting person in front of a work table, suitable recessed locations were found to free the working area from the lighting device after use (in the side under the top of the table, or inside a nearby wall). By moving the lighting device out of the way after a temporary use and stowing it into these nonintrusive and ready accessible locations an improved use was found that was missing in the prior art. This is also a new installation feature of the lighting device that creates free space on the tabletop. It is liked and required by most people.

The second inventive step is the making use of the single-sided bend-ability of the vertically polarized gooseneck and forcing it to wind into a horizontally mounted reel (the rotation axis of the reel is vertical; vertical polarization and horizontal orientation are of the essence in these application). The winding of a vertically polarized gooseneck into a reel is a special technical feature of this invention that the patent search conducted shows to be unforeseen, unexpected, and not suggested, or implied by any one or more patents or other documents of the prior art.

The above installation and structural features provide functionality and operational convenience that are critical for industrial applicability. The embodiments of the invention involve the same technical features as above mentioned that together form a single general inventive concept. The aforementioned installation and structural features, and others that are clearly shown in the drawings and disclosed in the description, define the contributions of this invention over the prior art.

The individual characteristics of various embodiments enhance the performance of the lighting device as shown in the specific details of the description and drawings.

Accordingly, the scope of the embodiments should be determined by the appended claims and their legal equivalents, rather than by the examples given.

What is claimed is:

1. A task lighting device recessible under a table, into a wall adjacent to said table, or into a pole stand, said task lighting device comprising:

a lighting source disposed in a recessed location under said table, said wall, or said pole stand, and said lighting source being equipped with gripping means for pulling out and repositioning said lighting source to a task lighting position with one hand, said lighting source having an electric-power switch, a retracting enclosure disposed under said table, inside said wall, or said pole stand, said retracting enclosure having either electric or mechanic urging means and a lock-and-release mechanism, a vertically polarized gooseneck having a first end and a second end, said vertically polarized gooseneck enclosing electric wires running along its length, said vertically polarized gooseneck being connected at said first end to said lighting source, and at said second end to said retracting enclosure, whereby a user can pull out said lighting source from said recessed location to said task lighting position, whereby said vertically polarized gooseneck holds said lighting source fixed in place in said task lighting position, whereby the user can activate said lock-and-release mechanism so that said vertically polarized gooseneck can be retracted into said retracting enclosure while pulling said lighting source to said recessed location.

2. The recessible task lighting device of claim 1 wherein said gripping means for pulling out and repositioning said lighting source is a finger-handle.

3. The recessible task lighting device of claim 1 wherein said retracting enclosure has a reel for winding said vertically polarized gooseneck.

4. The recessible task lighting device of claim 3 wherein said mechanic urging means is at least one spiral spring that rotates said reel.

5. The recessible task lighting device of claim 4 wherein said spiral springs are electric conductors incorporated into the circuit that conducts electricity to said lighting source.

6. The recessible task lighting device of claim 1 wherein said urging means is an electric motor.

7. The recessible task lighting device of claim 1 wherein said urging means is a compression coil spring which pulls said vertically polarized gooseneck in said retracting enclosure without winding it in a reel.

8. The recessible task lighting device of claim 1 wherein said gripping means are two side indents on said lighting source and two corresponding indents on said tableside or said wall, said indents and said corresponding indents matching and forming gripping apertures that fit comfortably inside at least two fingers of one hand for pulling out and repositioning said lighting source.

9. The recessible task lighting device of claim 1 wherein a block of guiding rollers is incorporated to guide said polarized gooseneck into entering and exiting said retracting enclosure.

10. The recessible task lighting device of claim 1 wherein said lighting source has pivotal connection with said vertically polarized gooseneck.

11. A method of providing recessible task lighting comprising:

providing an lighting source with gripping means for pulling out and repositioning of said lighting source with one hand, said lighting source being disposed on a recessed location, said lighting source being connected to the electric line and turned on and off by an electric switch, providing a retracting enclosure attached in the proximity of said recessed location, said retracting enclosure being urged by mechanic or electric means and equipped with a lock-and-release mechanism, providing a vertically polarized gooseneck having a first end and a second end, said vertically polarized gooseneck enclosing electric wires running along its length, connecting said first end of said vertically polarized gooseneck to said lighting source and said second end to said retracting enclosure, pulling out said lighting source from said recessed location to a task lighting position above a table, laptop, or other working area, on which said task lighting position said vertically polarized gooseneck holds said lighting source fixed in one place and fixed in one direction, activating said retracting enclosure to retract said vertically polarized gooseneck into said retracting enclosure while retracting said lighting source to said recessed location.

* * * * *